US008289220B2

(12) United States Patent
Maruyama et al.

(10) Patent No.: US 8,289,220 B2
(45) Date of Patent: Oct. 16, 2012

(54) RADIO COMMUNICATION SYSTEM, PERIODIC STRUCTURE REFLECTOR PLATE, AND TAPERED MUSHROOM STRUCTURE

(75) Inventors: Tamami Maruyama, Yokohama (JP); Shinji Uebayashi, Yokohama (JP); Tatsuo Furuno, Yokosuka (JP)

(73) Assignee: NTT DoCoMo, Inc., Tokyo (JP)

( * ) Notice: Subject to any disclaimer, the term of this patent is extended or adjusted under 35 U.S.C. 154(b) by 475 days.

(21) Appl. No.: 12/552,002

(22) Filed: Sep. 1, 2009

(65) Prior Publication Data

US 2010/0194657 A1 Aug. 5, 2010

(30) Foreign Application Priority Data

Sep. 1, 2008 (JP) ..... P2008-224181

(51) Int. Cl.
*H01Q 19/06* (2006.01)
*H01Q 19/10* (2006.01)
*H01Q 15/02* (2006.01)

(52) U.S. Cl. ..... 343/754; 343/755; 343/834; 343/909; 343/700 MS

(58) Field of Classification Search ..... 343/754, 343/755, 834, 909, 700 MS
See application file for complete search history.

(56) References Cited

U.S. PATENT DOCUMENTS

| | | | | |
|---|---|---|---|---|
| 6,888,500 | B2 * | 5/2005 | Brown et al. | 342/372 |
| 7,068,222 | B2 * | 6/2006 | Koparan et al. | 343/700 MS |
| 2008/0062059 | A1 * | 3/2008 | Freni et al. | 343/840 |

FOREIGN PATENT DOCUMENTS

| | | |
|---|---|---|
| JP | 8-288901 | 11/1996 |
| JP | 2007-96868 | 4/2007 |

OTHER PUBLICATIONS

Kihun Chang, et al., "High-impedance Surface with Nonidentical Lattices", iWAT, 2008, P315, pp. 474-477.
Takeshi Miyoshi, et al., "Reflectarray using mushroom structure with variable via position", The Institute of Electronics, Information and Communication Engineers, AP2007-11, Apr. 2007, pp. 59-63 (with English Abstract).
F. Venneri, et al., "Design of Microstrip Reflect Array Using Data From Isolated Patch Analysis", Microwave and Optical Technology Letters, vol. 34, No. 6, Sep. 20, 2002, pp. 411-414.
Junji Asada, "A Fundamental Study of Radar Absorber with Frequency Selective Surface", The Transactions of the Institute of Electronics, Information and Communication Engineers, vol. J90-B, No. 1, 2007, pp. 56-62 (with English-language translation).
Office Action issued Apr. 5, 2012 in Chinese Patent Application No. 2009101715797 (with English translation).

* cited by examiner

*Primary Examiner* — Hoang V Nguyen
(74) *Attorney, Agent, or Firm* — Oblon, Spivak, McClelland, Maier & Neustadt, L.L.P.

(57) ABSTRACT

The present invention relates to a radio communication system configured to secondarily-radiate, to a desired area by reflection, primarily-radiated radio waves from a transmitter apparatus, by using a reflector plate for controlling phases of reflected waves, wherein a reflecting property of the reflector plate is set so that the reflector plate reflects the primarily-radiated radio waves as plane waves of equal phase directed to a direction different from a reflection angle in the case of specular reflection.

18 Claims, 41 Drawing Sheets

Fig. 13

| | | |
|---|---|---|
| Incident wave | Frequency | 8.8GHz |
| | Incident direction | Vertical incidence |
| Reflected wave | Reflection Direction | 70 degrees |
| Substrate | Relative Permittivity | 4.4 |
| | tanδ | 0.016 |

Fig. 14

| | | |
|---|---|---|
| Size | $a_x$ | 1.80mm |
| | $a_y$ | 10.00mm |
| | t | 3.20mm |
| | $W_x$ | 1.20mm |
| | d | 0.30mm |

Fig. 18

| Patch No. | 0 | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| $W_y$[mm] | 1.0 | 2.32 | 3.10 | 3.58 | 4.02 | 4.36 | 4.68 | 4.99 | 5.33 | 5.69 | 6.16 | 6.72 | 7.59 | 9.04 | 9.9 |

XZ plane: graph of θ and dB
Z direction: 0°/X direction: 90°

Fig. 24

| | | |
|---|---|---|
| Incident wave | Frequency | 8.8GHz |
| | Incident direction | Vertical Incidence |
| Reflected wave | Reflection Direction | 70 degrees |
| Substrate | Relative Permittivity | 4.4 |
| | tanδ | 0.018 |

Fig. 25

| | |
|---|---|
| $a_x$ | 1.80mm |
| $a_y$ | 1.80mm |
| t | 3.20mm |
| $W_x$ | 1.20mm |
| d | 0.30mm |

Fig. 27

| Patch No. | 1 | 2 | 3 | 4 | 5 | 6 | 7 | 8 | 9 | 10 | 11 | 12 | 13 |
|---|---|---|---|---|---|---|---|---|---|---|---|---|---|
| Wy(mm) | 1.08 | 1.32 | 1.47 | 1.57 | 1.64 | 1.68 | 1.722 | 1.746 | 1.765 | 1.776 | 1.780 | 1.790 | 1.792 |

Fig. 29

| | | | |
|---|---|---|---|
| FR4 Relative Permittivity | 4.4 | Gap in X Direction: gx | 0.6mm |
| FR4tanδ | 0.018 | Patch Width in X Direction: Wx | 1.2mm |
| Thickness of FR4 Substrate | 3.2mm | One Period Length in X Direction: Ux | 36.0mm |
| Diameter of Via Hole | 0.50mm | Pitch in X Direction | 1.80mm |
| | | Pitch in Y Direction | 1.80mm |
| Gygap1 | 0.008mm | Ylength1 | 1.792mm |
| Gygap2 | 0.010mm | Ylength2 | 1.790mm |
| Gygap3 | 0.020mm | Ylength3 | 1.780mm |
| Gygap4 | 0.024mm | Ylength4 | 1.776mm |
| Gygap5 | 0.035mm | Ylength5 | 1.765mm |
| Gygap6 | 0.054mm | Ylength6 | 1.746mm |
| Gygap7 | 0.078mm | Ylength7 | 1.722mm |
| Gygap8 | 0.120mm | Ylength8 | 1.680mm |
| Gygap9 | 0.160mm | Ylength9 | 1.640mm |
| Gygap10 | 0.230mm | Ylength10 | 1.570mm |
| Gygap11 | 0.330mm | Ylength11 | 1.470mm |
| Gygap12 | 0.480mm | Ylength12 | 1.320mm |
| Gygap13 | 0.720mm | Ylength13 | 1.080mm |

XZ plane: graph of θ and dB
Z direction: 0°/X direction: 90°

RADIO COMMUNICATION SYSTEM, PERIODIC STRUCTURE REFLECTOR PLATE, AND TAPERED MUSHROOM STRUCTURE

1. FIELD OF THE INVENTION

The present invention relates to a radio communication system, a periodic structure reflector plate, and a tapered mushroom structure. For example, the present invention relates to a radio communication system including the following functions.

(1) A function in which such a reflecting property is set in a reflector plate for controlling a phase of a reflected wave (reflection phase) that primarily-radiated radio waves from a transmitter apparatus are reflected as plane waves of an equal phase directed to a desired area in a direction different from a regular reflection (specifically, a specular reflection).

(2) A function to configure a reflector plate which is large enough for a wavelength, through periodic arrangement of structures controlling a reflection angle by controlling a phase difference of reflected waves.

2. DESCRIPTION OF THE RELATED ART

In recent years, research on meta-material has been active, and, as described in the non-Patent Document 1 (see "High-impedance Surface with Nonidentical Lattices", K. Chang, J. Ahn and Y. J. Yoon, iWAT2008, p 315, pp 474 to 477), there is discussed a technique for controlling a radiation direction by adding a taper (inclination) in a mushroom structure to give reflected waves a phase difference.

FIG. 44 shows a tapered mushroom structure shown in Non-Patent Document 1. As shown in FIG. 44, such a tapered mushroom structure is formed of mushroom elements having 11 patches of L1 to L11 which have different lengths. Table 1 shows detailed dimensions of the mushroom structure shown in FIG. 44.

TABLE 1

| Parameter | Value | Parameter | Value |
|---|---|---|---|
| $L_1$ | 17.70 mm | $L_2$ | 18.27 mm |
| $L_3$ | 18.66 mm | $L_4$ | 19.00 mm |
| $L_5$ | 19.28 mm | $L_6$ | 19.53 mm |
| $L_7$ | 19.77 mm | $L_8$ | 20.00 mm |
| $L_9$ | 20.23 mm | $L_{10}$ | 20.47 mm |
| | | $L_{11}$ | 20.70 mm |
| Width of Unit Cell Δx | | | 17 mm |
| Length of Unit Cell Δy | | | 23 mm |
| Phase Difference between Adjacent Cells Δφ | | | π/10 |

As shown in FIG. 45, resonance frequencies of the periodically arranged mushroom structures as shown in FIG. 44 vary by changing a patch size.

FIG. 45 shows phases of reflected waves for the mushroom elements having length from L1 to L11 in the tapered mushroom structure shown in FIG. 44.

As shown in FIG. 45, at 2.4 GHz, the phase is −90° when the length is L11 (20.70 mm), whereas, the phase is 90° when the length is L1 (17.70 mm).

In order to control a phase of a reflected wave and direct the reflected wave to a desired direction, it is desirable that the phase can be changed freely from −180° (−Πradians) to 180° (Π radians).

When a case of a conventional tapered mushroom structure is considered, according to the transmission line theory, phases of reflected waves are approximately determined based on a gap interval between patches being adjacent in a Y axis direction of FIG. 44. However, when length of the patches in the Y axis direction is too small compared with the patch interval, it is difficult to apply the transmission line theory and the phases of the reflected waves no longer changes. In addition, the patch interval can be made small when the length of the patch in the Y axis direction is increased. However, there is a limit in manufacturing if the length is made too small.

For these reasons, the conventional tapered mushroom structure cannot ensure a sufficient dynamic range.

In addition, the tapered mushroom structure shown in FIG. 44 is sized 161 mm in the Y axis direction and 187 mm in the X axis direction, and any of them is 1.5λ or less, which is not sufficiently large as a reflector plate for reflecting radio waves.

Furthermore, in control of a phase difference using the tapered mushroom structure shown in FIG. 44, a reflection angle θ and a periodic interval Δx (pitch) in the X axis direction have a relationship approximated by an expression #1A "$\theta=\sin^{-1}((\lambda\cdot\Delta\Phi)/(2\Pi\cdot\Delta x))$".

Design values in FIG. 44 and Table 1 are those when the reflection angle θ is approximately 22°. However, there has been a disadvantage that when the reflection angle θ is further increased, Δx is made smaller in accordance with (the expression #1A), and the entire size of the reflector plate is also made smaller.

In addition, in the conventional tapered mushroom structure, a method of controlling beam in an orthogonal direction (direction Y, in this case) has not been considered at all.

As described above, in the conventional tapered mushroom structure, there has been a disadvantage that a large reflector plate cannot be constructed because there is a limit in a phase difference to be obtained by changing dimensions of respective mushroom elements which form a periodic structure.

BRIEF SUMMARY OF THE INVENTION

Hence, the present invention has been made in light of the above problems, and aims to provide a radio communication system, a periodic structure reflector plate and a tapered mushroom structure which can: (1) configure a large sized reflector plate having a function to control a direction in which reflected waves travel so that the reflected waves travel in a desired direction; (2) control the desired direction by changing a period of the reflector plate; and (3) control a direction in which the reflected waves travel, in a two-dimensional manner (i.e. in the X-Y directions).

A first aspect of the present invention is summarized as a radio communication system configured to secondarily-radiate, to a desired area by reflection, primarily-radiated radio waves from a transmitter apparatus, by using a reflector plate for controlling phases of reflected waves, wherein a reflecting property of the reflector plate is set so that the reflector plate reflects the primarily-radiated radio waves as plane waves of equal phase directed to a direction different from a reflection angle in the case of specular reflection.

In the first aspect, the reflector plate can be formed by a frequency selective reflector plate; and the reflecting property of the reflector plate can be set so that the reflector plate reflects only radio waves of one or a plurality of predetermined frequency bands, among the primarily-radiated radio waves, as the plane waves of the equal phase directed to the direction different from the reflection angle in the case of the specular reflection.

A second aspect of the present invention is summarized as a periodic structure reflector plate including a structure in which structures each for controlling a reflection angle by controlling a phase difference of reflected waves are periodically arranged.

In the second aspect, in n reflector plate constituent pieces $r_k$ ($1 \leqq k \leqq n$) arranged at intervals of $\Delta S_k$, when a phase of reflected wave in each reflector plate constituent piece $r_k$ is $\Phi_k$, a phase difference ($\Phi_{k+1}-\Phi_k$) between each reflector plate constituent piece $r_k$ and an adjacent reflector plate constituent piece $r_{k+1}$ is $\Delta\Phi_k$, and wavelength of the reflected wave is $\lambda$, a plurality of blocks can be provided for every period T ($T \geqq RL$), each of the blocks being formed of the n reflector plate constituent pieces $r_k$ that are arranged to satisfy an expression #1 "$\alpha=\sin^{-1}(\lambda\cdot\Delta\Phi_k/2\Pi\cdot\Delta S_k)$" for an angle $\alpha$ indicative of a traveling direction of desired reflected wave, each of the blocks having a length RL specified by:

$$RL = \sum_{K=1}^{n} \Delta S_k$$

In the second aspect, the period T can be a value for which "$T=\lambda/\sin\alpha$" is true.

A third aspect of the present invention is summarized as a tapered mushroom structure formed of mushroom elements including a dielectric substrate having a metal ground plate as a bottom face, strip-shaped patches formed on an upper surface of the dielectric substrate, and short pins short-circuiting the metal ground plate and the patches, wherein n mushroom elements are arranged at predetermined intervals of $\Delta X_i$ in an X axis direction, and m mushroom elements are arranged at predetermined intervals of $\Delta Y_j$ in a Y axis direction; the length $LY_{ij}$ of each mushroom element in the Y axis direction is changed by being inclined along the X axis direction, the length $LX_{ij}$ of each mushroom element in the X axis direction is changed by being inclined along the Y axis direction, or not only the length $LY_{ij}$ of each mushroom element in the Y axis direction is changed by being inclined along the X axis direction, but also the length $LX_{ij}$ of each mushroom element in the X axis direction is changed by being inclined along the Y axis direction; and the length of each mushroom element is determined so that a phase of a reflection coefficient when radio wave is reflected in each mushroom element is parallel to a straight line set arbitrarily on an XY plane.

A forth of the present invention is summarized as a tapered mushroom structure formed of mushroom elements including a dielectric substrate having a metal ground plate as a bottom face, strip-shaped patches formed on an upper surface of the dielectric substrate, and short pins short-circuiting the metal ground plate and the patches, wherein n mushroom elements are arranged at predetermined intervals of $\Delta X_i$ in an X axis direction, and m mushroom elements are arranged at predetermined intervals of $\Delta Y_j$ in a Y axis direction; the length $LY_{ij}$ of each mushroom element in the Y axis direction is changed by being inclined along the Y axis direction, the length $LX_{ij}$ of each mushroom element in the X axis direction is changed by being inclined along the X axis direction, or not only the length $LY_{ij}$ of each mushroom element in the Y axis direction is changed by being inclined along the Y axis direction but also the length $LX_{ij}$ of each mushroom element in the X axis direction is changed by being inclined along the X axis direction; and the length of each mushroom element is determined so that a phase of a reflection coefficient when radio waves are reflected at each mushroom element is parallel to a straight line arbitrarily set on an XY plane.

In the third aspect and the forth aspect, the length $LY_{ij}$ of each mushroom element in the Y axis direction can be changed by being inclined along the Y axis direction and the X axis direction.

In the third aspect and the forth aspect, the length $LX_{1j}$ of each mushroom element in the X axis direction can be changed by being inclined along the Y axis direction and the X axis direction.

In the third aspect and the forth aspect, if the m or n mushroom elements cannot be arranged due to restrictions on the length $LX_{ij}$ in the X axis direction and the length $LY_{ij}$ in the Y axis direction which are determined by the predetermined intervals $\Delta X_i$ and $\Delta Y_j$, blocks in which the mushroom elements are arranged at the predetermined intervals $\Delta X_i$ in the X axis direction and at the predetermined intervals $\Delta Y_j$ in the Y axis direction can be periodically and repeatedly arranged.

In the third aspect and the forth aspect, each mushroom element can be arranged so that there is no lag in a phase difference between the $k^{th}$ mushroom element and the $k-1^{th}$ mushroom element with respect to any k.

In the third aspect and the forth aspect, each mushroom element can be arranged so that there is no phase difference between the $p^{th}$ period and the $p-1^{th}$ period with respect to any P.

In the third aspect and the forth aspect, in the mushroom elements to be arranged at intervals of $\Delta x$, when a phase difference of a reflection coefficient at each mushroom element is $\Delta\Phi$ and wavelength of a reflected wave is $\lambda$, an angle $\alpha$ indicative of a desired traveling direction of a reflected wave can be determined by an expression #2 "$\alpha=\sin^{-1}(\lambda\cdot\Delta\Phi/2\Pi\cdot\Delta X)$"; the reflection coefficient $\Gamma$ can be determined by an expression #3 "$\Gamma=(Z_s-\eta)/(Z_s+\eta)=|\Gamma|\exp(j)$", using a free space impedance $\eta$ and a surface impedance $Z_s$; and when the surface impedance $Z_s$ is determined by an expression #4 "$Z_s=j\omega L/(1-\omega^2 LC)$", using inductance L and capacitance C which are determined by the tapered mushroom structure, the i mushroom elements can be arranged in the X axis direction, the phases of the reflection coefficient, which are approximately determined from the inductance L and the capacitance C, can be at regular intervals for the every interval $\Delta x$ so that the phase difference $\Delta\Phi$ will be equal, and blocks in which the i mushroom elements are arranged in the X axis direction can be arranged at intervals of a predetermined period T.

In the second aspect, the tapered mushroom structure according to any one of the third aspect and the forth aspect can be configured.

In the second aspect, a direction in which the reflected wave propagates can be varied by changing a period T of each block depending on the radio wave propagation environment in the surroundings where the periodic structure reflector plate is installed.

In the first aspect, the periodic structure reflector plate according to the second aspect can be used as the reflector plate.

In the first aspect, the transmitter apparatus can be any one of a radio base station and a mobile station.

BRIEF DESCRIPTION OF THE DRAWINGS

FIG. 5 is a view showing a tapered mushroom structure according to a second embodiment of the present invention.

FIG. 13 is a view showing design conditions of the tapered mushroom structure according to the fourth embodiment of the present invention.

FIG. 14 is a view showing values of the structural parameters of the tapered mushroom structure according to the fourth embodiment of the present invention.

FIG. 16 is a view showing values of each $W_y$ when values of $W_y$ are determined, and values of gaps between adjacent mushroom elements, in the tapered mushroom structure according to the fourth embodiment of the present invention.

FIG. 24 is a view showing design conditions of the tapered mushroom structure according to the seventh embodiment of the present invention.

FIG. 25 is a view showing values of the structural parameters of the tapered mushroom structure of the seventh embodiment of the present invention.

FIG. 26 is a graph showing values of phases of the reflection coefficients to $W_y$ when length $W_y$ of the mushroom element in the Y axis direction is changed, in the tapered mushroom structure according to the seventh embodiment of the present invention.

FIG. 27 is a view showing values of one block forming the tapered mushroom structure according to the seventh embodiment of the present invention.

FIG. 29 is a view showing details of the structural parameters to be used in the tapered mushroom structure according to the seventh embodiment of the present invention.

FIG. 36 is a view showing a tapered mushroom structure according to Modification Example 1 of the present invention.

FIG. 38 is a contour figure of phases of reflection coefficients in the tapered mushroom structure according to Modification Example 1 of the present invention.

FIG. 45 is a graph showing values of phases of reflection coefficients when values of length of mushroom elements in Y axis direction are changed in the conventional tapered mushroom structure.

DESCRIPTION OF THE PREFERRED EMBODIMENTS

In the following, embodiments of the present invention will be described in detail with reference to the drawings.

First Embodiment of the Present Invention

A tapered mushroom structure of a first embodiment of the present invention will be described with reference to FIG. 1.

Figure 1:
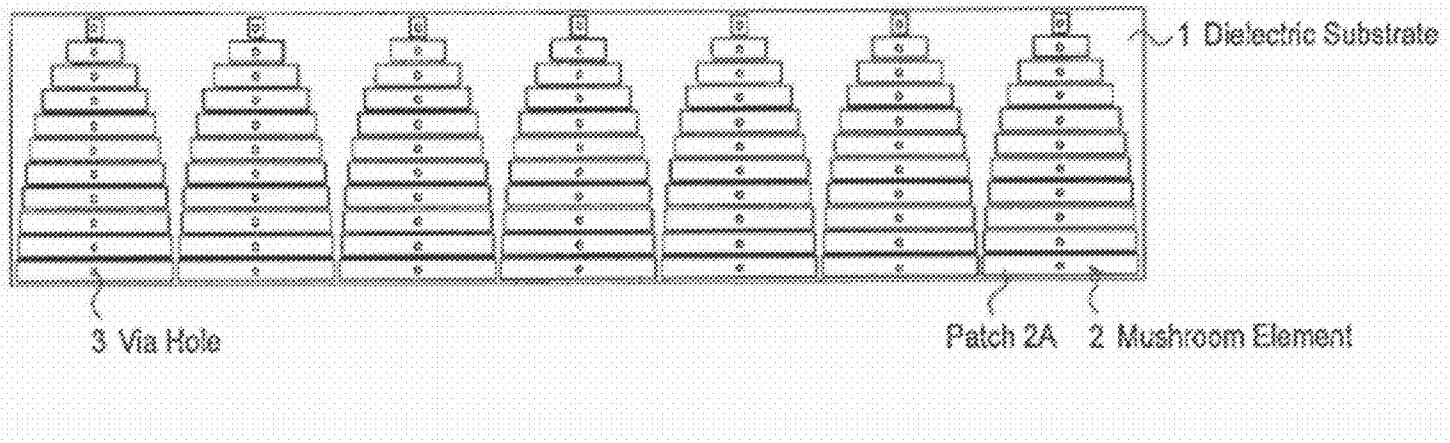
FIG. 1 is a view showing a tapered mushroom structure according to a first embodiment of the present invention.

FIG. 1 shows the tapered mushroom structure according to this embodiment, in which 11 mushroom elements 2 are arranged at predetermined intervals $\Delta X_i$ in an X axis direction (vertical direction) and 7 mushroom elements 2 are arranged at predetermined intervals of $\Delta Y_j$ in a Y axis direction (horizontal direction).

As shown in FIG. 1, the mushroom element 2 includes a dielectric substrate 1 having a metal ground plate as a bottom face, strip-shaped patches 2A configured on a top surface of the dielectric substrate 1, and a short pin 3 for short-circuiting the metal ground plate and the patches 2A.

In the example of FIG. 1, length of each mushroom element 2 in the Y axis direction is configured to change as it inclines along the X axis direction. In other words, in the tapered mushroom structure according to this embodiment, taper (inclination) is given in the vertical direction, and as a result, a phase of a reflected wave can be changed.

of the reflection coefficient to an adjacent mushroom element is $\Delta\phi$. In this case, an angle (reflection angle) $\alpha$ indicative of a traveling direction of a desired reflected wave can be expressed by an expression #5 "$\alpha=\sin-1((\lambda\cdot\Delta\Phi)/(2\Pi\cdot\Delta x))$".

Here, the reflection coefficient $\Gamma$ can be expressed as an expression #6 "$\Gamma=(Z_s-\eta)/(Z_s+\eta)=|\Gamma|\exp(j)$" by using a free space impedance $\eta$ and a surface impedance $Z_s$.

The surface impedance $Z_s$ can be expressed as an expression #7 "$Z_s=j\omega L/(1-\omega^2 LC)$" by using the inductance L and the capacitance C which depend on the tapered mushroom structure.

Here, the inductance L is expressed by an expression #8 "$L=\mu o\cdot t$", when thickness of the dielectric substrate 1 is t and magnetic permeability of the free space is $\mu o$.

In addition, the capacitance C is expressed by an expression #9.

$$C = \frac{\varepsilon_o(1+\varepsilon_r)W_x}{\pi}\operatorname{arccosh}\left(\frac{\Delta y}{\Delta y - W_y}\right) \quad \text{(expression\# 9)}$$

The tapered mushroom structure according to this embodiment can be increased in the horizontal direction. However, the tapered mushroom structure cannot be increased in the vertical direction, because the pitch is already determined and there is a limit in producing mushroom elements shorter or longer than the current ones.

Figure 2:
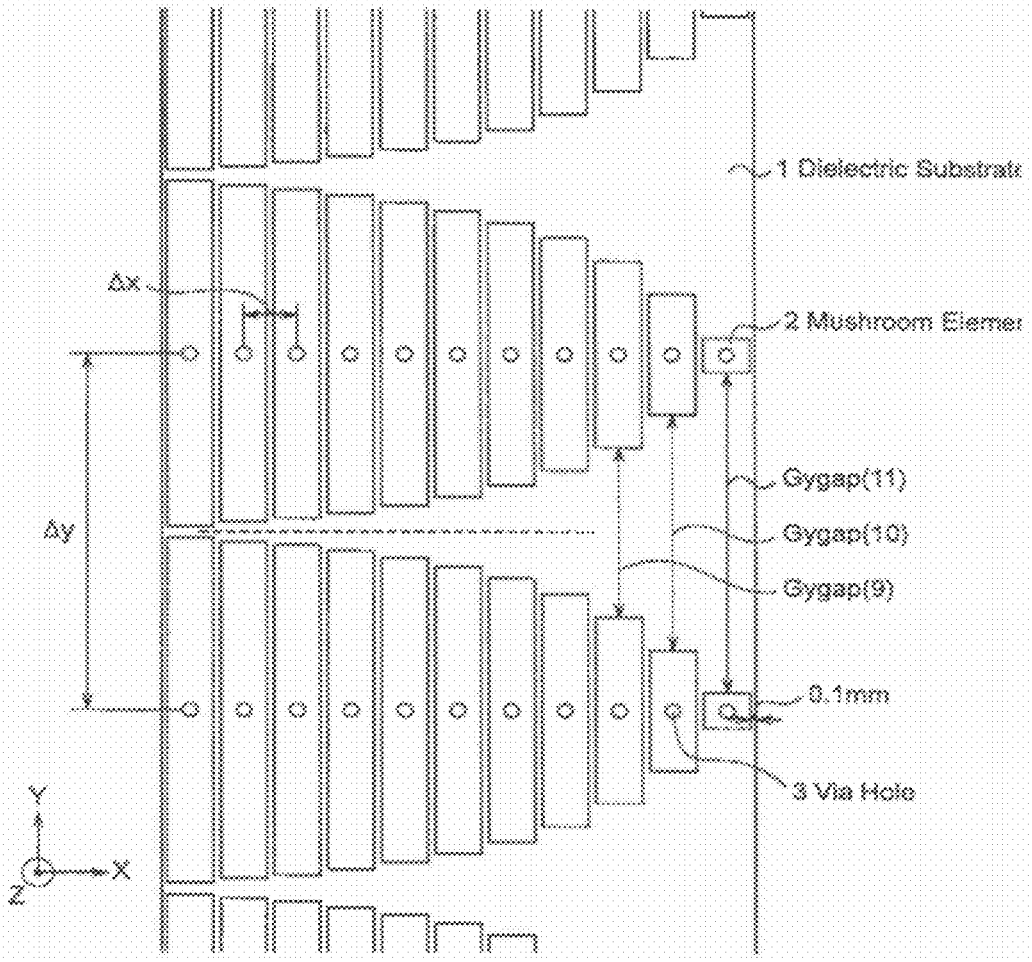
FIG. 2 is a view showing structural parameters of the tapered mushroom structure according to the first embodiment of the present invention.
Figure 3:
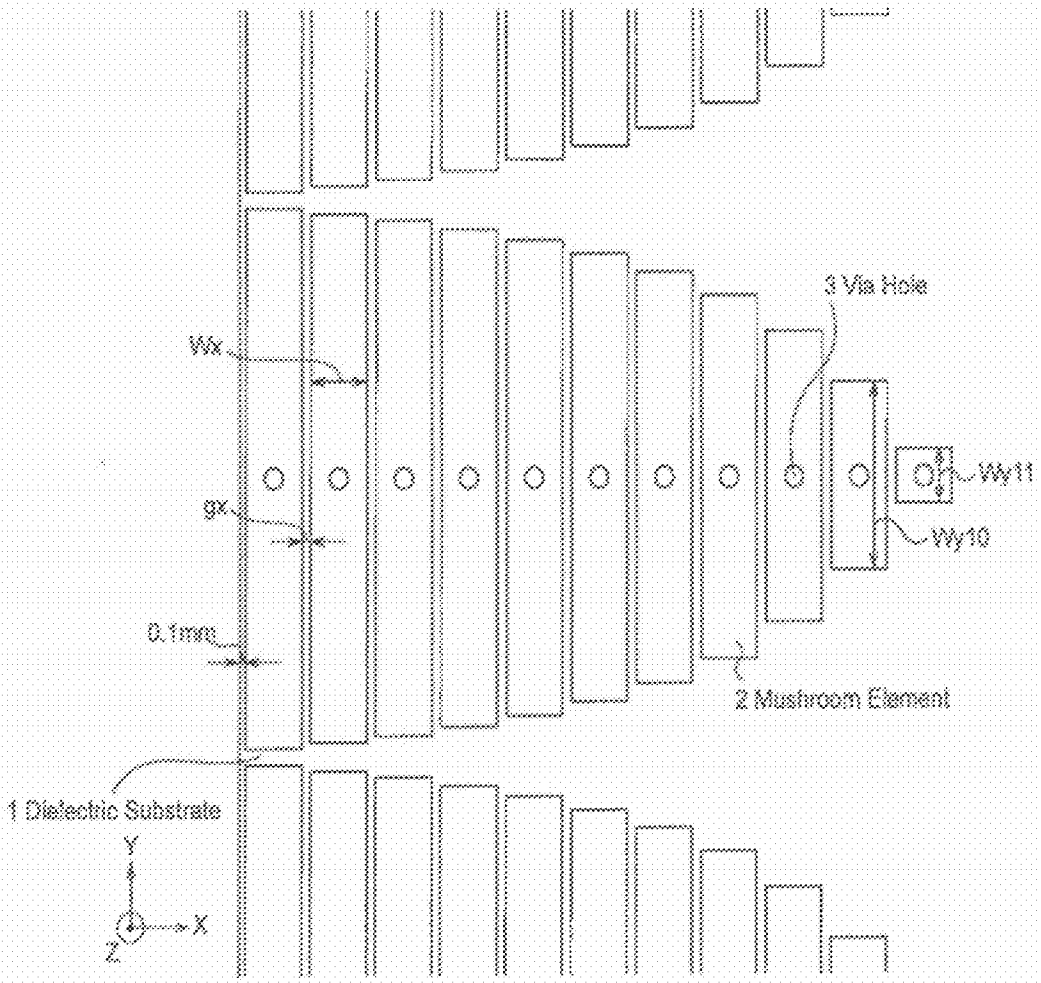
FIG. 3 is a view showing structural parameters of the tapered mushroom structure according to the first embodiment of the present invention.

FIG. 2 and FIG. 3 show respective parameters when the phases are configured to change at equal intervals between $-\Pi/2$ and $\Pi/2$ by using approximate expressions of the expression #5 to the expression #9, and Table 2 shows values of such parameters.

TABLE 2

| | | | |
|---|---|---|---|
| Gap in X direction: gx | 0.2 mm | Gygap(1) = 0.299580 mm | Ylength(1) = 9.700420 mm |
| Thickness of substrate t | 3.2 mm | Gygap(2) = 0.499814 mm | Ylength(2) = 9.500186 mm |
| Relative permittivity $\epsilon r$ | 4.9 | Gygap(3) = 0.749932 mm | Ylength(3) = 9.250068 mm |
| Center frequency | 12 GHz | Gygap(4) = 1.058274 mm | Ylength(4) = 8.941726 mm |
| Pitch in X direction: $\Delta y$ | 10 mm | Gygap(5) = 1.442206 mm | Ylength(5) = 8.557794 mm |
| Desired angle $\alpha$ | 70° | Gygap(6) = 1.932170 mm | Ylength(6) = 8.067830 mm |
| Phase difference of reflected waves | $\pi/10$ | Gygap(7) = 2.579860 mm | Ylength(7) = 7.420140 mm |
| Patch width in X direction: Wx | 1.1302 mm | Gygap(8) = 3.473434 mm | Ylength(8) = 6.526566 mm |
| Wavelength | 25 mm | Gygap(9) = 4.760696 mm | Ylength(9) = 5.239304 mm |
| Pitch in X direction: $\Delta x$ | 1.33 mm | Gygap(10) = 6.645830 mm | Ylength(10) = 3.354170 mm |
| | | Gygap(11) = 9.049691 mm | Ylength(11) = 0.950309 mm |

The following two methods are known as examples each for a design of the tapered mushroom structure.

(1) A method of making the design in an approximate manner by using a left-handed transmission line model since the mushroom structure has a structure with inductance L and capacitance C of a usual transmission line model inverted (2) A method of aligning a phase of a reflected wave in each mushroom element with a desired direction, similar to a reflect array.

In this embodiment, the left-handed transmission line model of (1) is used. A method of designing each mushroom element of this embodiment will be described hereinafter.

FIG. 2 and FIG. 3 show structural parameters of the tapered mushroom structure according to this embodiment.

In FIG. 2, consider interval of the mushroom elements in the X axis direction $\Delta x$. Here, assume that a phase of a reflection coefficient when a plane wave enters from a front direction of the reflector plate (positive direction of a Z axis in FIG. 1 to FIG. 3) to the reflector plate configured in the tapered mushroom structure is $\phi$, and that a phase difference In FIG. 2, the interval of the mushroom elements in the X axis direction is expressed by $\Delta x$, the interval of the mushroom elements in the X axis direction is expressed by $\Delta y$, and spacing (gap) of the $n^{th}$ mushroom element in the Y axis direction is expressed by $G_{ygap}$ (n).

In FIG. 3, Wx is a width of the mushroom element in the X axis direction, gx is a gap between the mushroom elements in the X axis direction, $W_{ynj}$ is a width of the $n^{th}$ mushroom element in the Y axis direction, and $Y_{length}$(n) is a length of the $n^{th}$ mushroom element in the Y direction.

Figure 4:
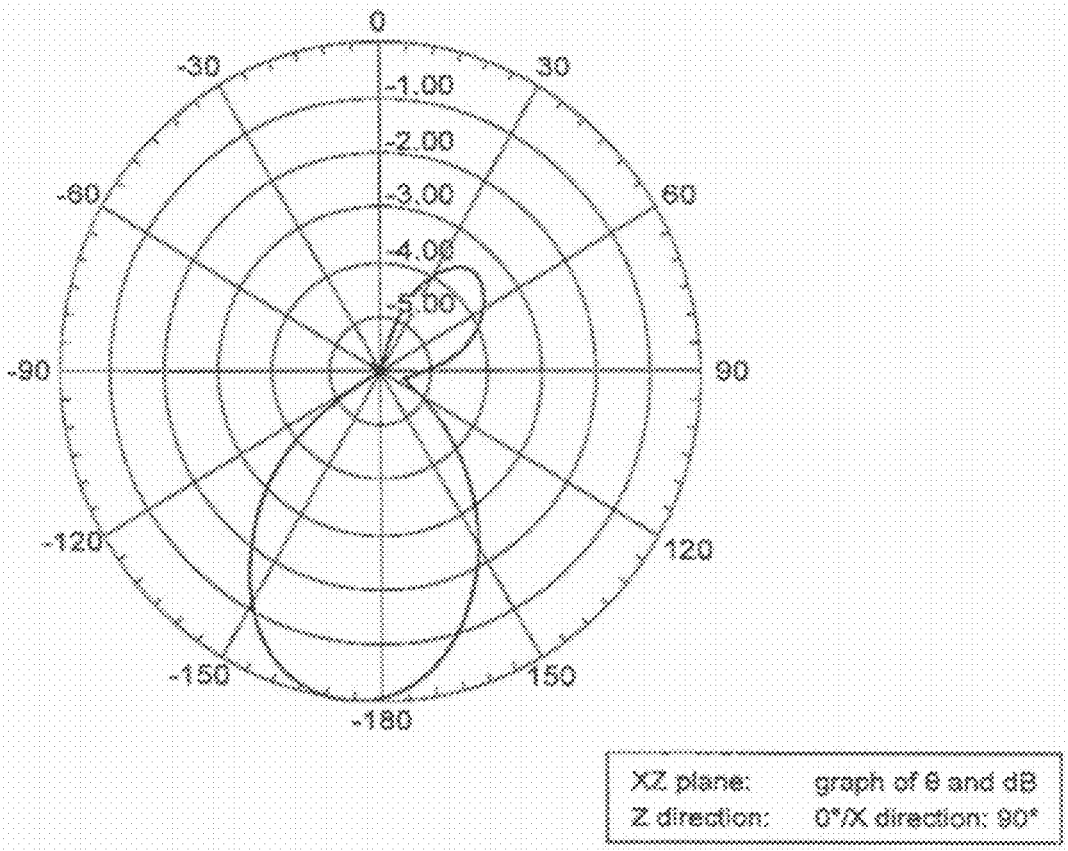
FIG. 4 is a graph showing a far scattered field in the tapered mushroom structure according to the first embodiment of the present invention.

FIG. 4 shows analysis result of a far scattered field of the tapered mushroom structure according to this embodiment. FIG. 4 shows a result when plane waves are given to the reflector plate in a positive direction of the Z axis.

As shown in FIG. 4, it can be seen from such a result that radio waves are not radiated in a direction of $\theta=0°$, which is the direction of specular reflection, and bend to the direction inclined 45°. However, in this case, the number of the mushroom elements is 11×7, and the phases in the X axis direction only move from $-\Pi/2$ to $\Pi/2$. Due to this effect, a designed value of a main beam of a reflected wave is $\alpha=70°$, whereas, the main beam of actual reflected wave is different therefrom and has inclination of 45°.

Figure 43:
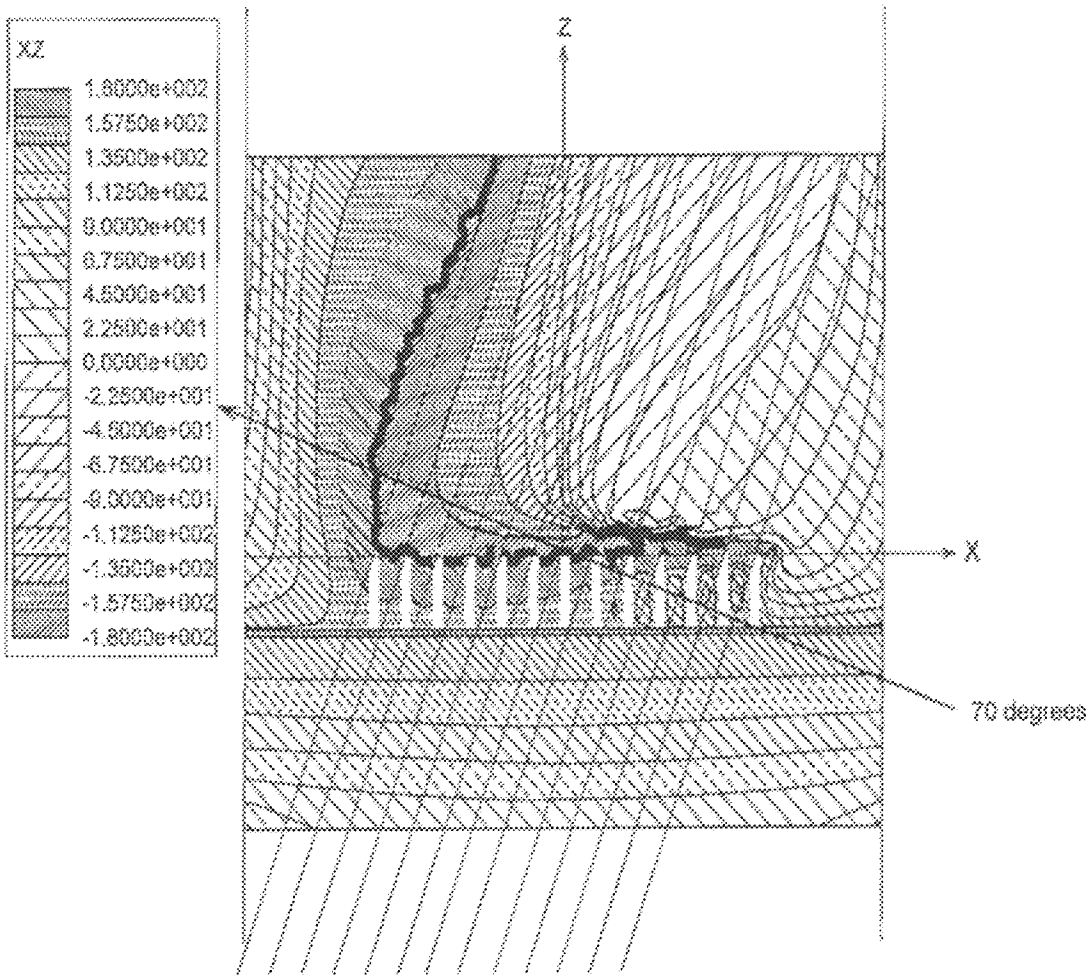
FIG. 43 is a contour figure of phases of reflection coefficients in the tapered mushroom structure according to the first embodiment of the present invention.
Figure 44:
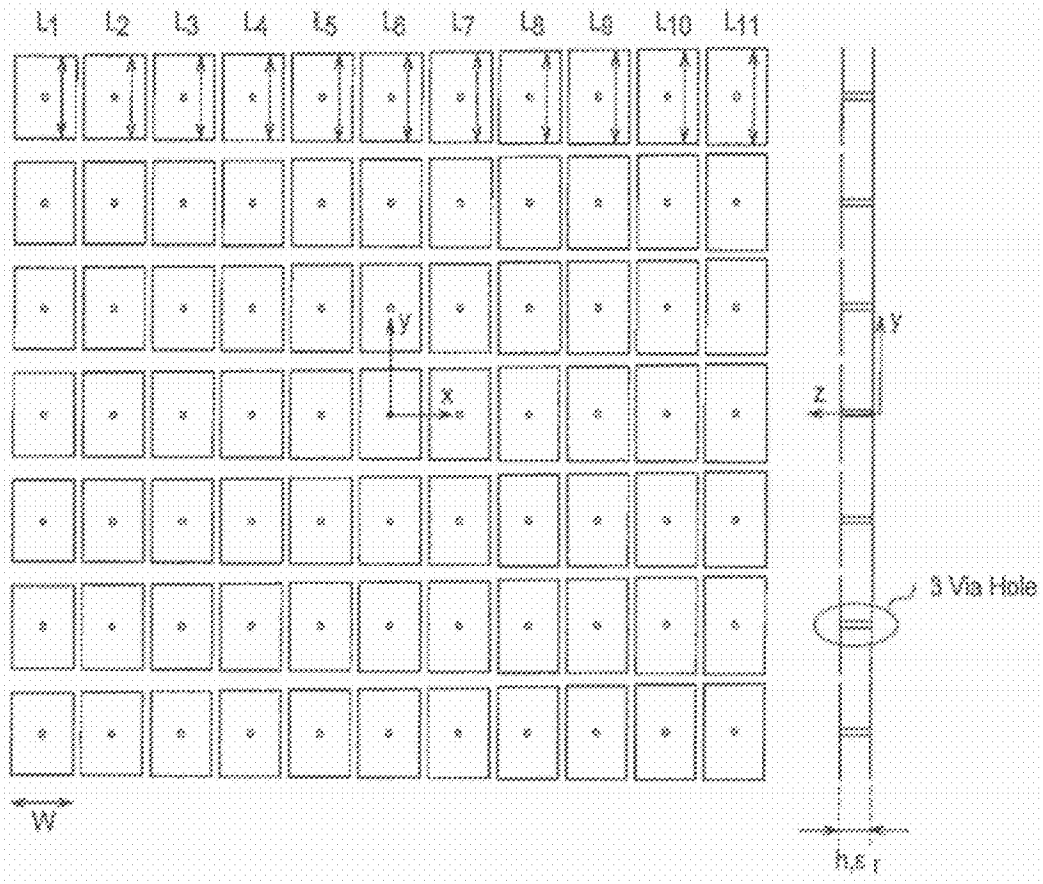
FIG. 44 is a view showing a conventional tapered mushroom structure.
Figure 46:
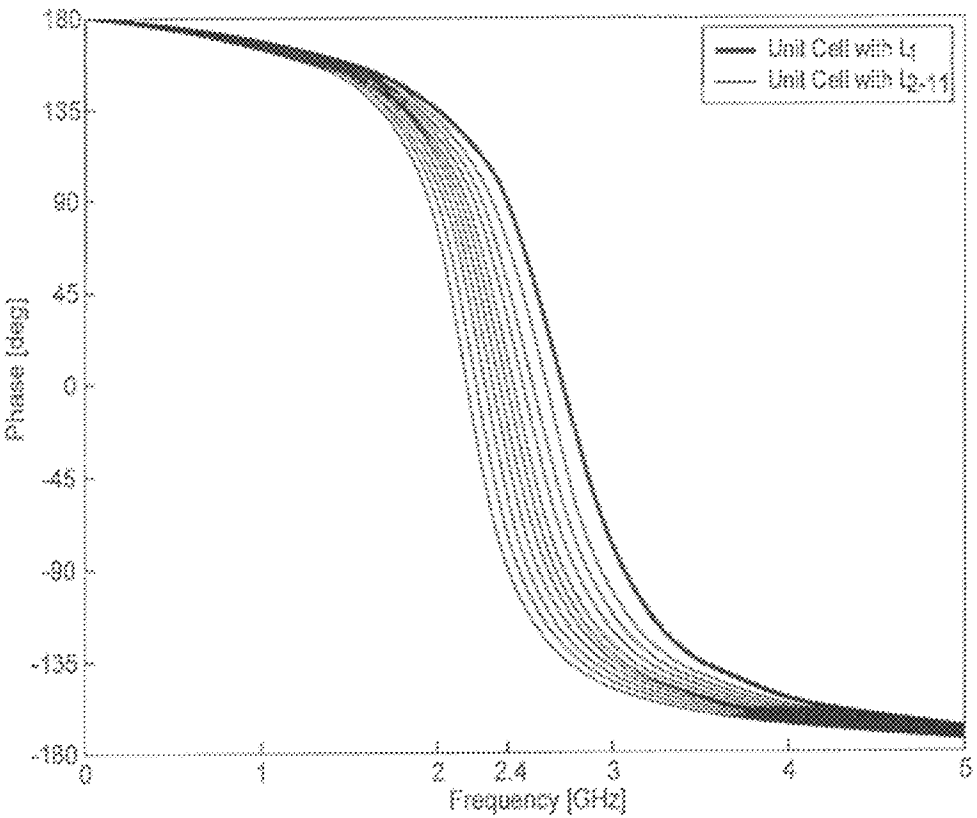

In addition, the tapered mushroom structure according to this embodiment may also be configured to determine the length of each mushroom element, so that the phases of the reflection coefficients when radio waves are reflected at each mushroom element are parallel to a straight line arbitrarily set on the XY plane (see FIG. 43).

Second Embodiment of Present Invention

A tapered mushroom structure according to a second embodiment of the present invention will be described hereinafter.

As shown in FIG. 5, in the tapered mushroom structure according to this embodiment, a collection of 1×11 mushroom elements (see FIG. 6), which are tapered based on the method of designing shown in FIG. 2 and FIG. 3, is defined as one block. These blocks are periodically arranged in the vertical direction (X axis direction) and the horizontal direction (Y axis direction).

Figure 7B:
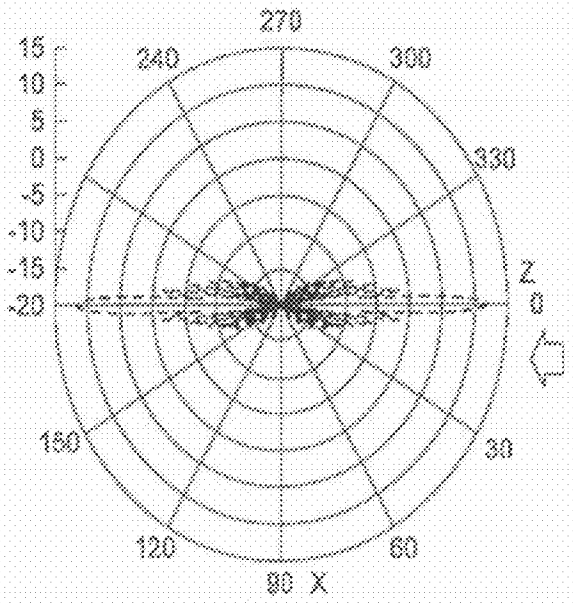
FIGS. 7A and 7B are graphs showing far scattered fields in the tapered mushroom structure according to the second embodiment of the present invention.
Figure 7A:
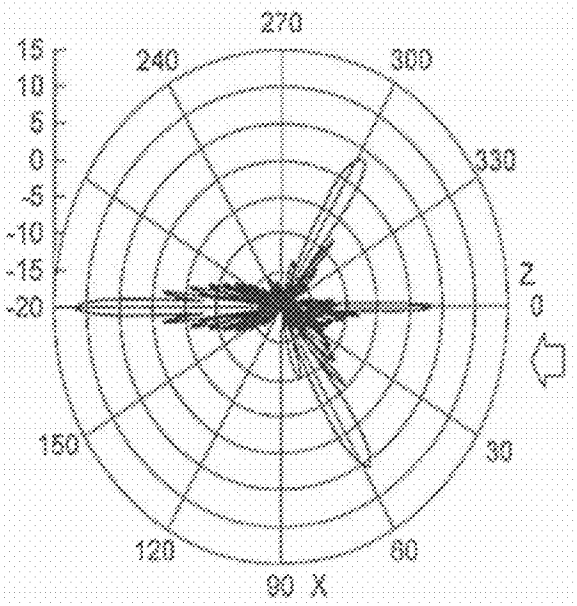
Figure 8:
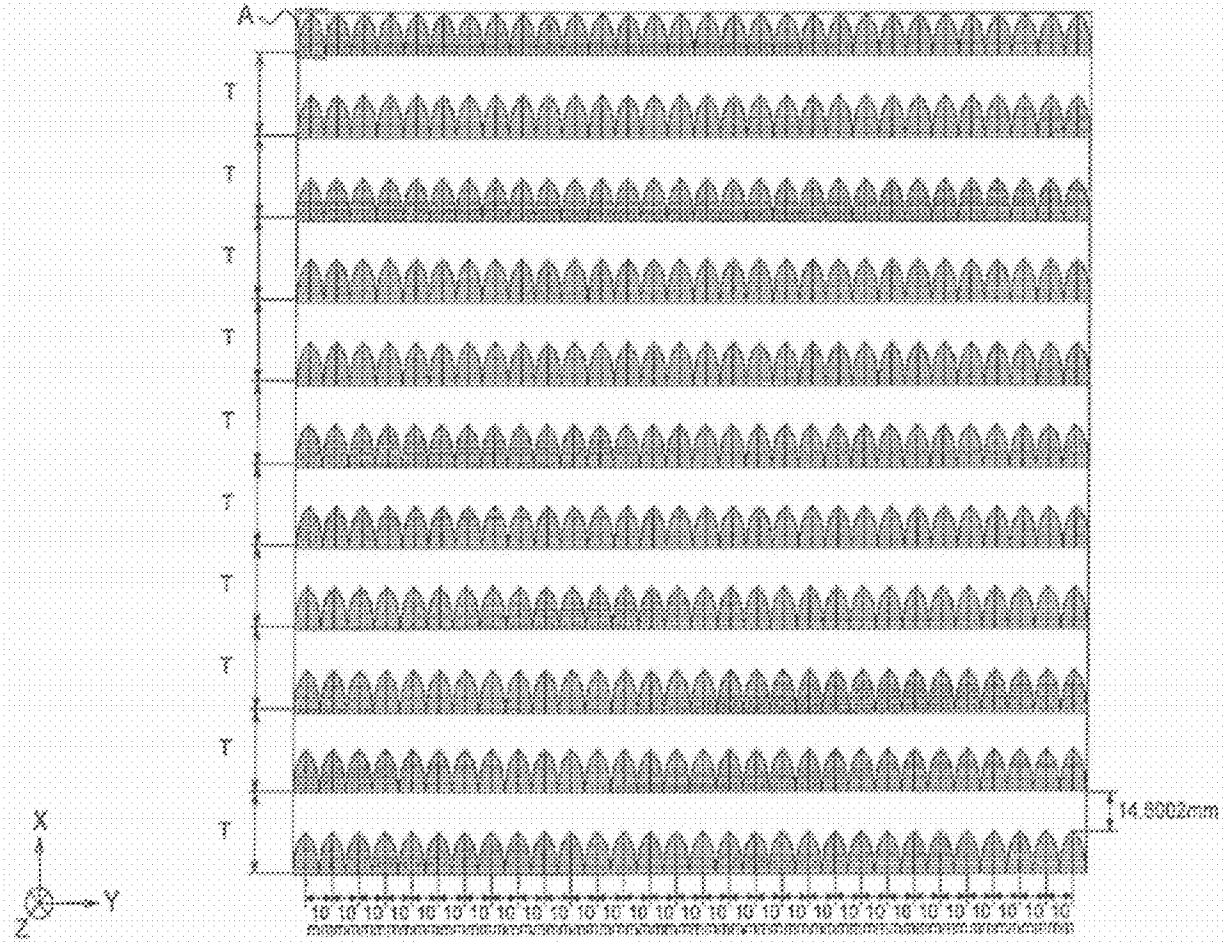

In this embodiment, as shown in FIG. 5, a period in the vertical direction is 29.0324 mm. FIG. 7A and FIG. 7B show properties of the far scattered field of the tapered mushroom structure according to this embodiment.

FIG. 7A shows a result of analysis by a finite element method of the far scattered field of the tapered mushroom structure as shown in FIG. 5, and FIG. 7B shows a result of analysis by the finite element method of the far scattered field of a metal flat plate having the same size as that in FIG. 7A.

It can be seen that in the case of the tapered mushroom structure according to this embodiment, radio waves are radiated to a direction of about 58°, which is 10° less than a designed value, at a level higher than those in the direction 0° of the specular reflection, while in the case of the metal flat plate, reflected waves are only directed to a direction of the specular reflection.

Third Embodiment of the Present Invention

A tapered mushroom structure according to the third embodiment of the present invention will be described hereinafter.

Figure 8:
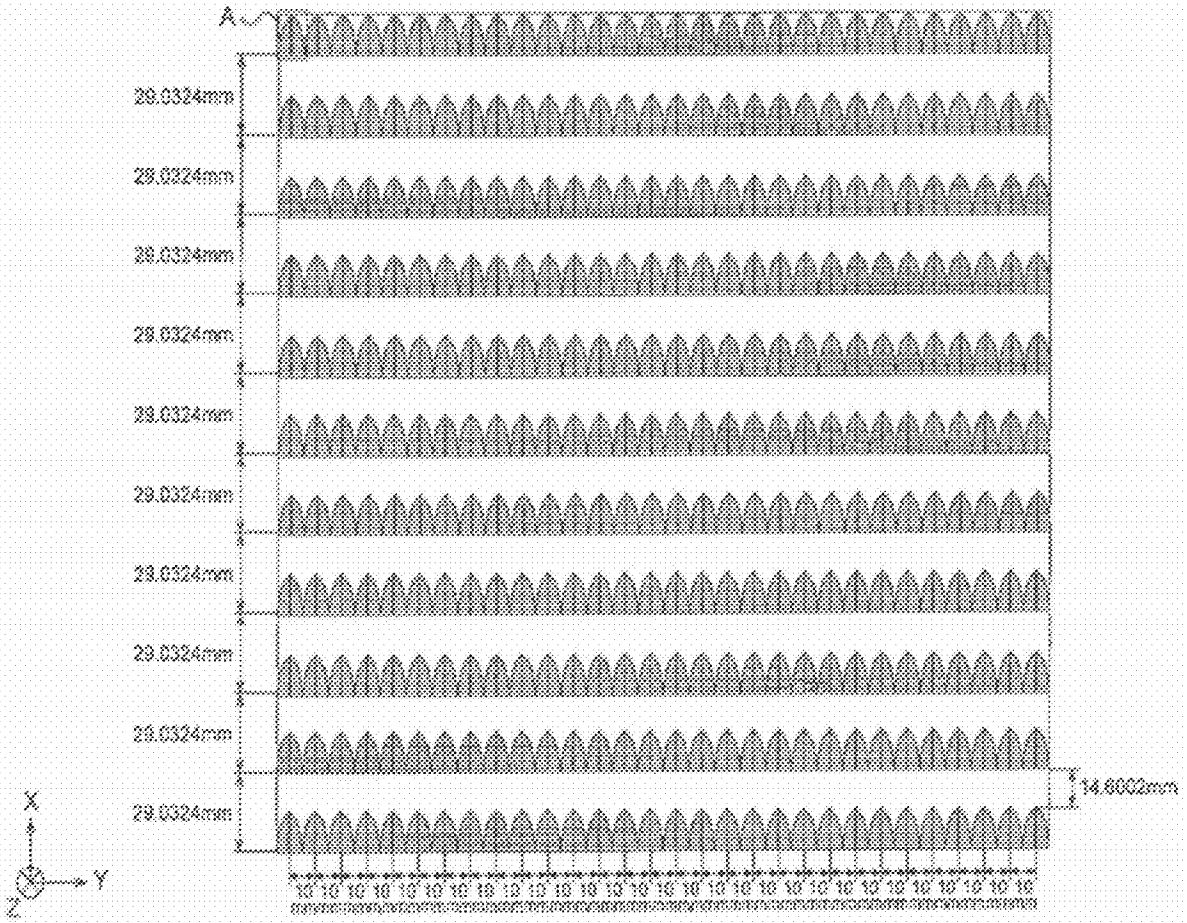
FIG. 8 is a view showing a tapered mushroom structure according to a third embodiment of the present invention.

In the tapered mushroom structure according to this embodiment, as shown in FIG. 8, a period T of the above-mentioned block is 26.6 mm, and at 12 GHz, "$T=\lambda/\sin\alpha$" is satisfied when $\alpha=70°$.

Figure 9:
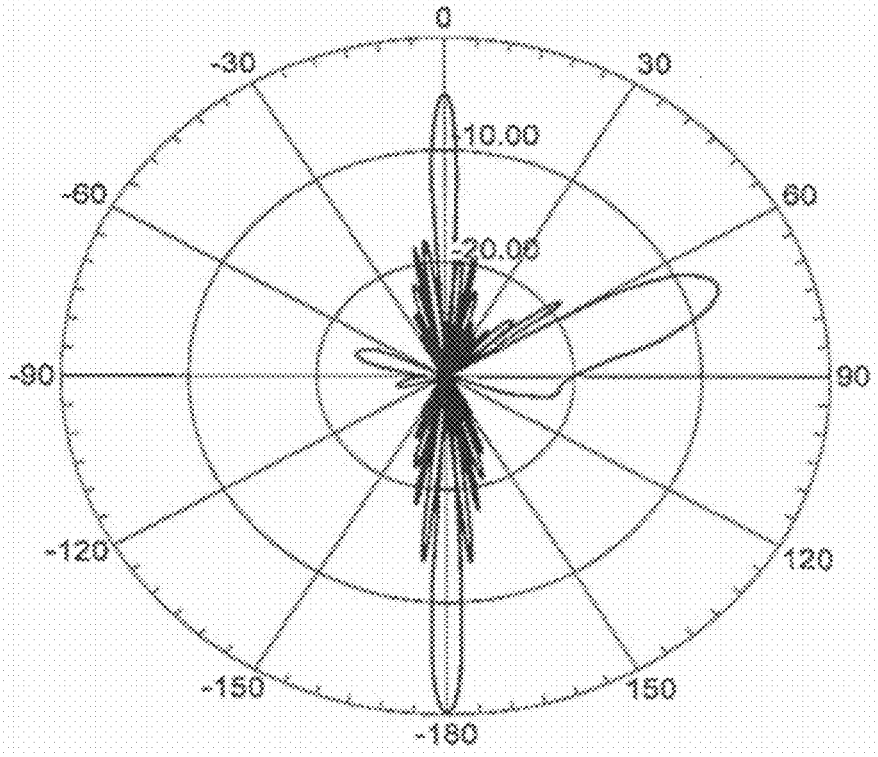
FIG. 9 is a graph showing a far scattered field in the tapered mushroom structure according to the third embodiment of the present invention.

FIG. 9 shows a far scattered field of the tapered mushroom structure according to this embodiment. It can be seen that the beam is directed to $\alpha=70°$, which is a desired direction of the reflected waves, by making the period "$T=\lambda/\sin\alpha$", and that level of the beam in the direction of −70°, which existed in FIG. 7A, is controlled, while the beam is directed to the 58° direction in the example of FIG. 7A.

Fourth Embodiment of the Present Invention

A tapered mushroom structure according to a fourth embodiment of the present invention will be described hereinafter.

Figure 10:
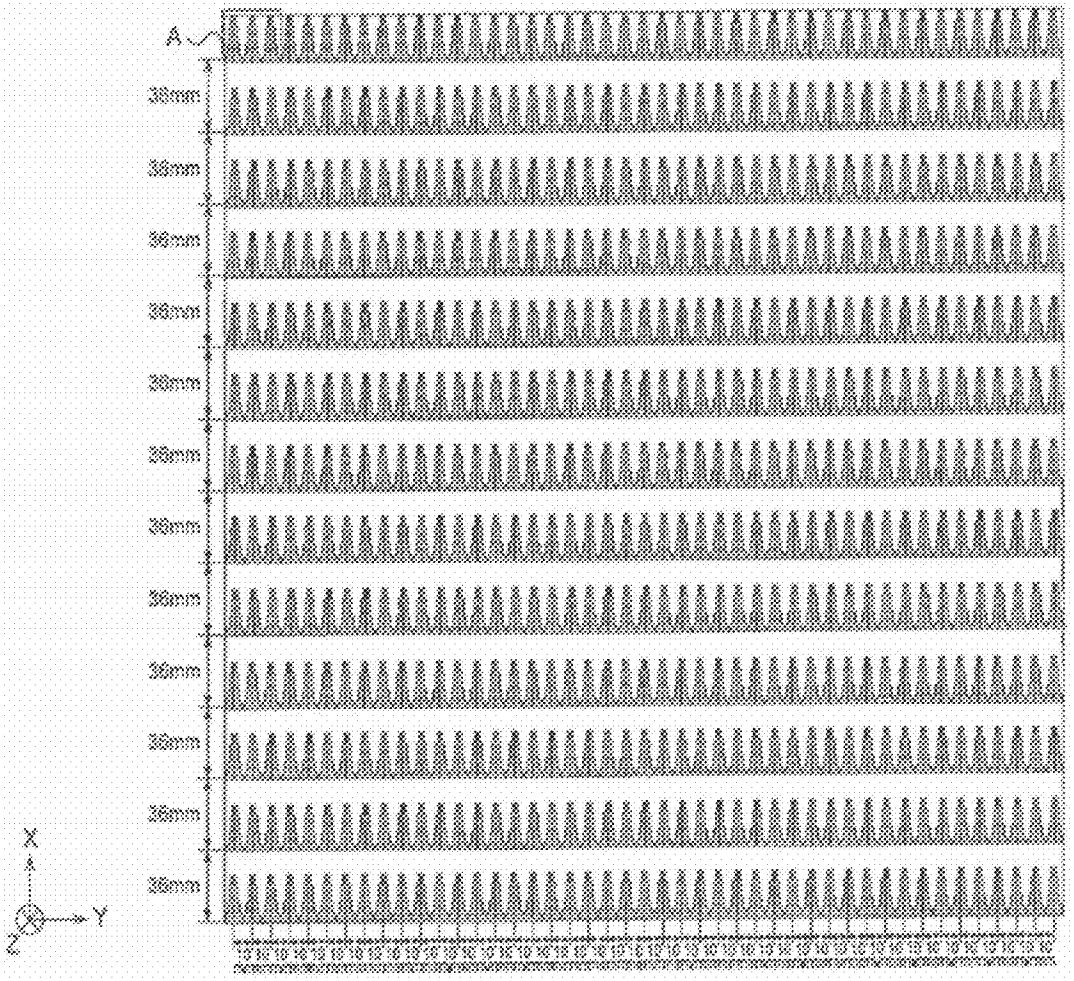
FIG. 10 is a view showing a tapered mushroom structure according to a fourth embodiment of the present invention.

FIG. 10 shows the tapered mushroom structure of the third embodiment of the present invention which is designed as $\alpha=70°$ at 8.8 GHz. FIG. 10 is a general view of the tapered mushroom structure in which the mushroom elements are arranged with the period of 36 mm at 8.8 GHz.

In FIG. 10, a periodic structure reflector plate (tapered mushroom structure) of 450 mm×450 mm is created by arranging 13 blocks of the mushroom elements in the X axis direction and 45 blocks in the Y axis direction, each block being formed of 13 mushroom elements arranged in the X axis direction.

Figure 11:
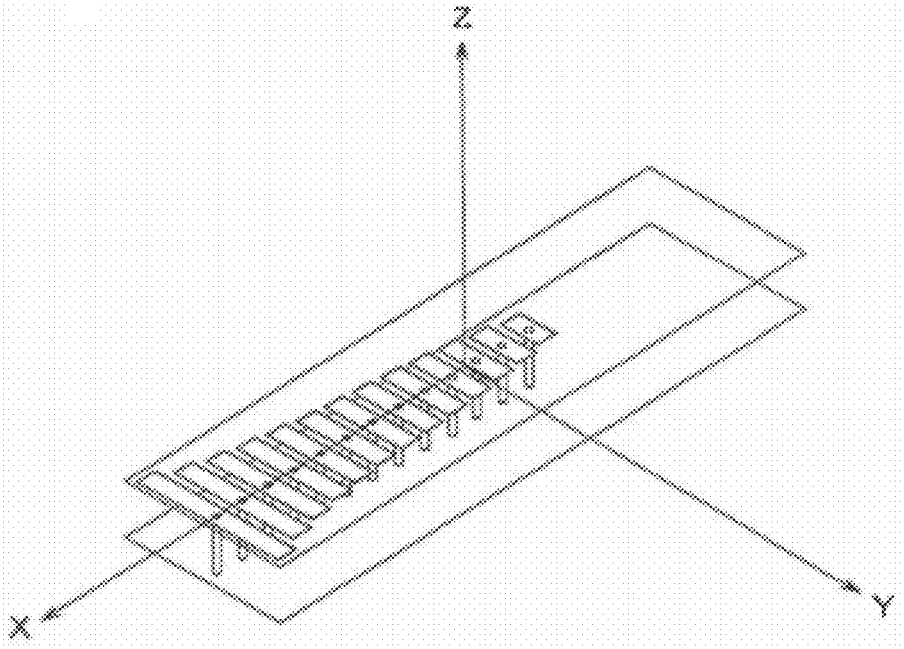
FIG. 11 is a view showing one block forming the tapered mushroom structure according to the fourth embodiment of the present invention.
Figure 12:
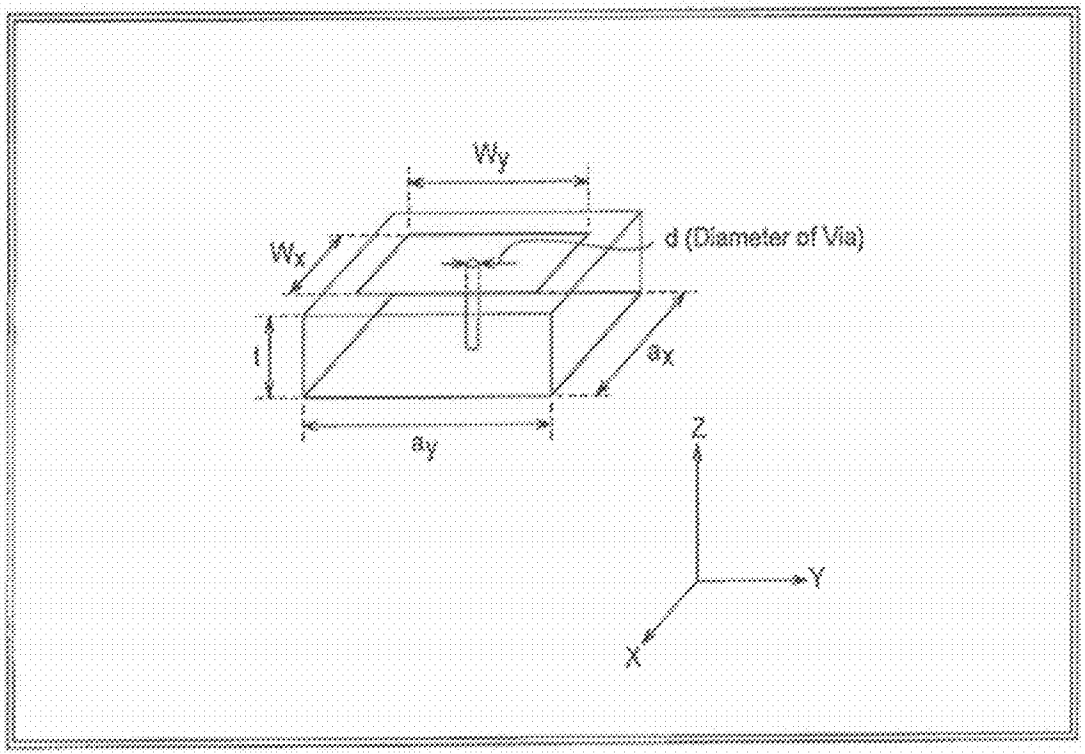
FIG. 12 is a view showing structural parameters of the tapered mushroom structure according to the fourth embodiment of the present invention.

FIG. 11 shows a structure of such a block, and FIG. 12 shows a structure of the mushroom element forming each block.

In this embodiment, design conditions are as shown in FIG. 13. In other words, the frequency is 8.8 GHz and vertically polarized wave is used, a reflection direction of reflected wave is $\alpha=70°$, thickness of the dielectric substrate 1 is 3.20 mm, and the relative permittivity of the dielectric substrate 1 is $\in_r=4.4$.

In addition, for structural parameters of the mushroom element shown in FIG. 12, as shown in FIG. 14, pitch $a_x$ in the X axis direction is 1.80 mm, pitch $a_y$ in the Y axis direction is 10 mm, width $W_x$ of the mushroom element in the X axis direction is 1.20 mm, and a diameter d of a via is 0.30 mm.

Here, a value of $a_x$ is a value of $\Delta_x$ in the expression #5 when the phase difference $\Delta\phi$ of the reflection coefficient is $\Pi/10$ and the angle $\alpha$ indicative of the traveling direction of the desired reflected wave is 70°.

Figure 15:
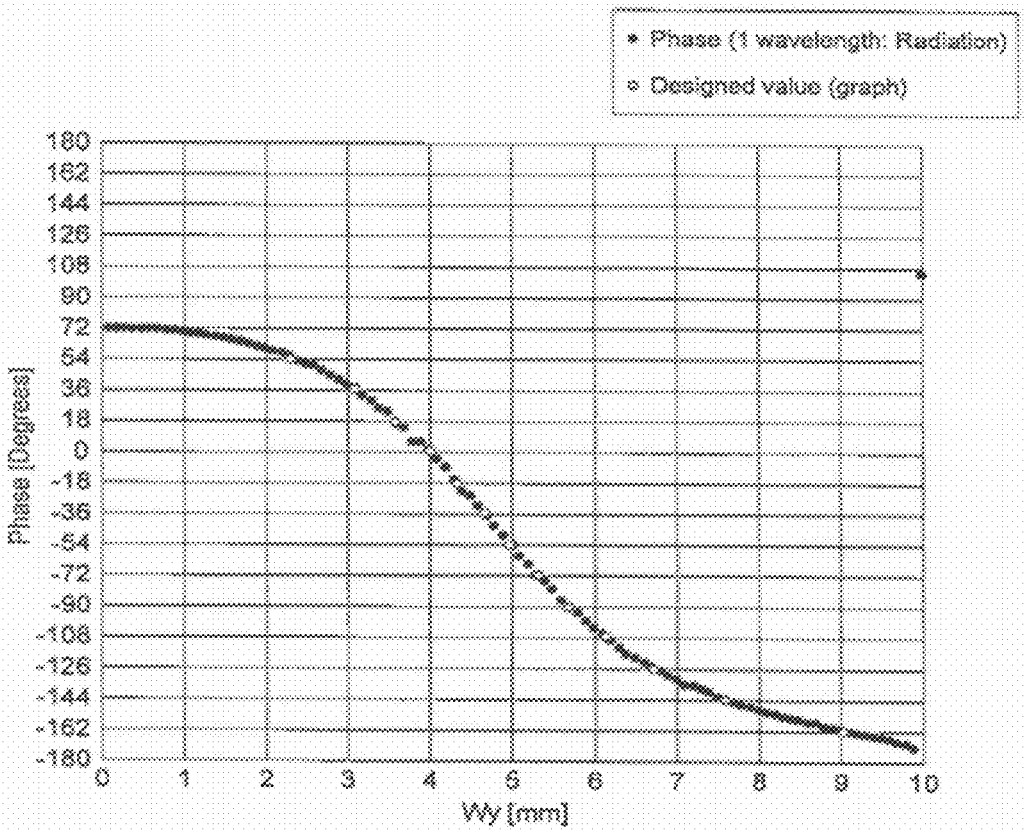
FIG. 15 is a graph showing values of phases of reflection coefficients to $W_y$ when length $W_y$ of the mushroom element in the Y axis direction is changed, in the tapered mushroom structure according to the fourth embodiment of the present invention.

In this embodiment, FIG. 15 shows a result of determination of a value for the phase of the reflection coefficient to $W_y$ when a value of length $W_y$ of the mushroom elements in the Y axis direction is changed after the structural parameters are set, as shown in FIG. 14.

In order to bend beams to a desired direction, a value of $W_y$, for which a phase difference changes by $\Pi/10°$, may be determined from FIG. 15.

FIG. 16 shows values of respective $W_y$ when the value of $W_y$, of the tapered mushroom structure is determined and values of gaps of adjacent mushroom elements. FIG. 16 shows values of the structural parameters for 3 blocks, for descriptive purposes.

Figure 17:
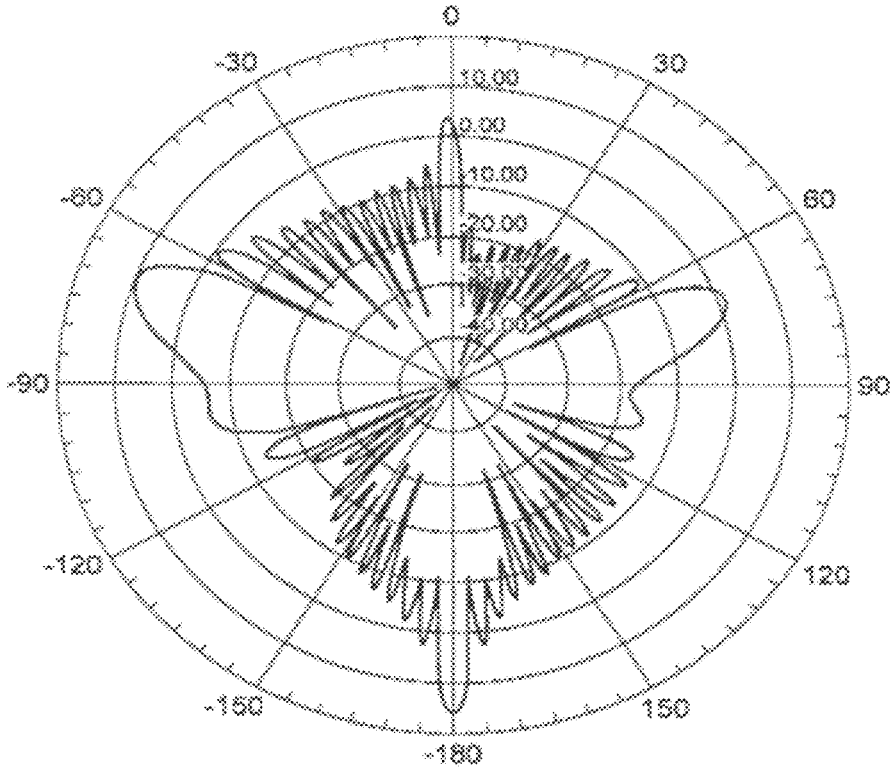
FIG. 17 is a graph showing a far scattered field in the tapered mushroom structure according to the fourth embodiment of the present invention.

FIG. 17 shows a far scattered field of the tapered mushroom structure according to this embodiment. As shown in FIG. 17, with such far scattered field, beams are directed to the direction which is inclined 70°, and the radiation level is higher than the direction of specular reflection $\theta=0°$.

Fifth Embodiment of the Present Invention

A tapered mushroom structure according to a fifth embodiment of the present invention will be described hereinafter. The tapered mushroom structure according to the present invention has an effect of directing beams to a desired direction, even when the number of the mushroom elements is increased or decreased. In addition, in the tapered mushroom structure according to this embodiment, a direction in which a taper is given may be a positive direction or a negative direction.

In this embodiment, there are 15 mushroom elements, obtained by adding short mushroom elements and long mushroom elements to the tapered mushroom structure according to the fourth embodiment, and a direction in which taper is given shall be the opposite side to the tapered mushroom structure according to the fourth embodiment.

Figure 18:
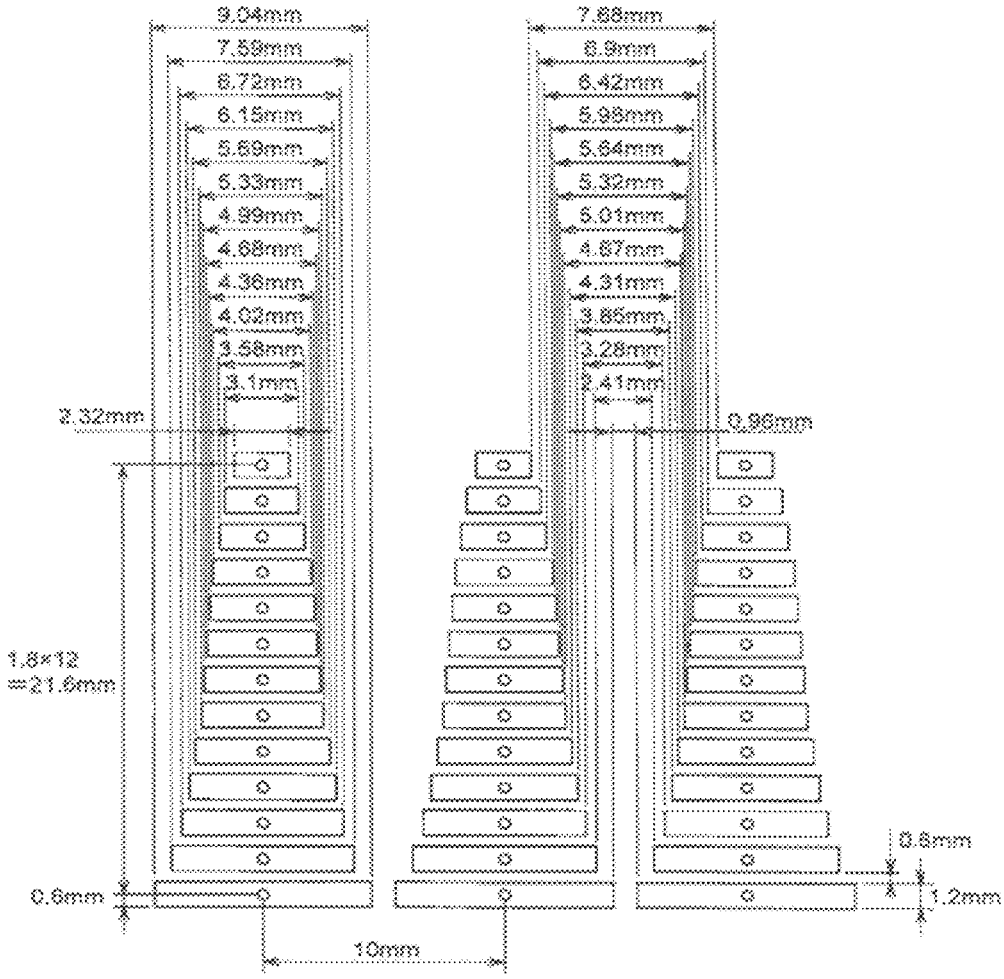
FIG. 18 is a view showing the length of a tapered mushroom structure for one block in a tapered mushroom structure according to a fifth embodiment of the present invention.

FIG. 18 shows lengths of one block forming the tapered mushroom structure of this embodiment, that is to say, lengths of the 15 mushroom elements of the tapered mushroom structure.

Figure 19:
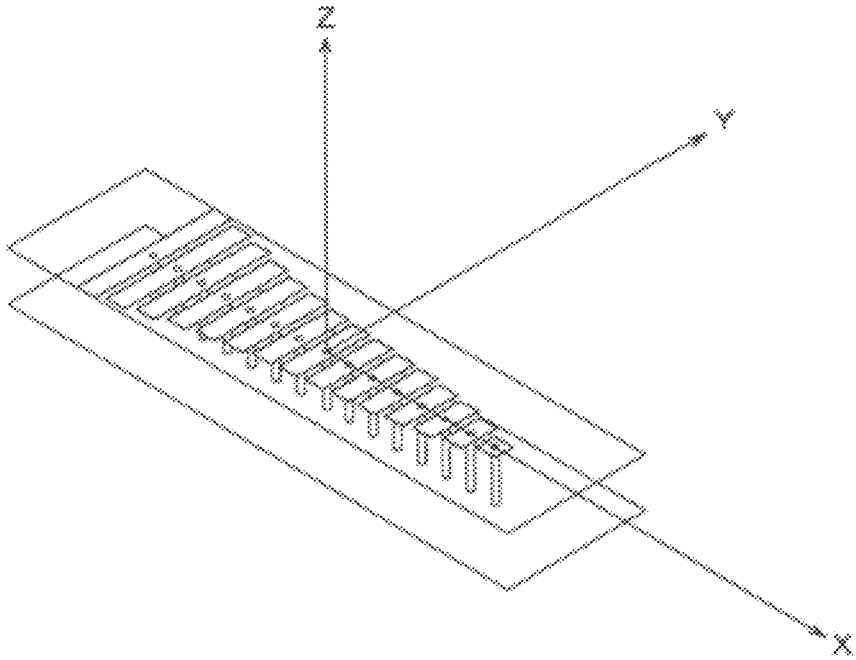
FIG. 19 is a view showing one block forming the tapered mushroom structure according to the fifth embodiment of the present invention.

In this embodiment, in the structure of one block shown in FIG. 19, 45 mushroom elements are arranged in the Y axis direction and 13 mushroom elements are arranged in the X axis direction.

Figure 20:
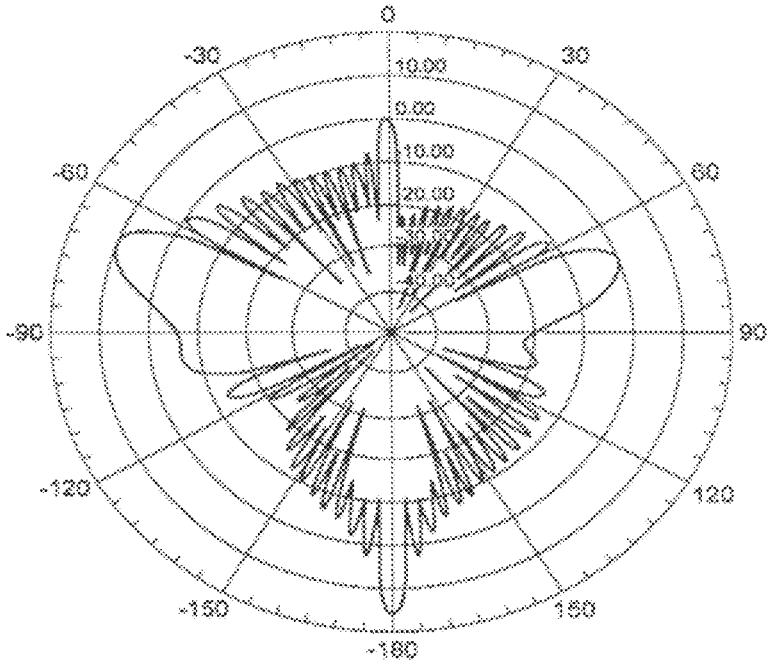
FIG. 20 is a graph showing a far scattered field in the tapered mushroom structure according to the fifth embodiment of the present invention.

FIG. 20 shows a far scattered field then. As shown in FIG. 20, it can be seen that the reflected waves are directed to a desired direction, which is a direction of −70°.

In addition, when compared with the result of FIG. 17 in which the reflector plate of the same size is created with the number of the mushroom elements shown in the fourth embodiment of the present invention being 13, the beams (beams of −70° in FIG. 20) in the 70° direction, which is the desired direction, are at 9.37 dB in the case of the 15 mushroom elements, the level of which is higher than 9.12 dB in the case of the 13 mushroom elements.

In contrast, the level of the direction of the specular reflection is 3.66 dB in the case of the 13 mushroom elements, and −0.16 dB in the case of the 15 mushroom elements. In other words, it can be seen that the case of the 15 mushroom elements is more effective to bend beams of reflected waves.

Sixth Embodiment of the Present Invention

A tapered mushroom structure according to the present invention may change size of a reflector plate by changing the number of blocks to be arranged in a period direction.

In the tapered mushroom structure according to a sixth embodiment of the present invention, the number of mushroom elements in one block shall be 13, which is the same as the case of the fourth embodiment, and a reflector plate of 300 $mm^2$ is formed by arranging 30 blocks in the Y axis direction and 11 blocks in the X axis direction with the period being 36 mm.

Figure 21:
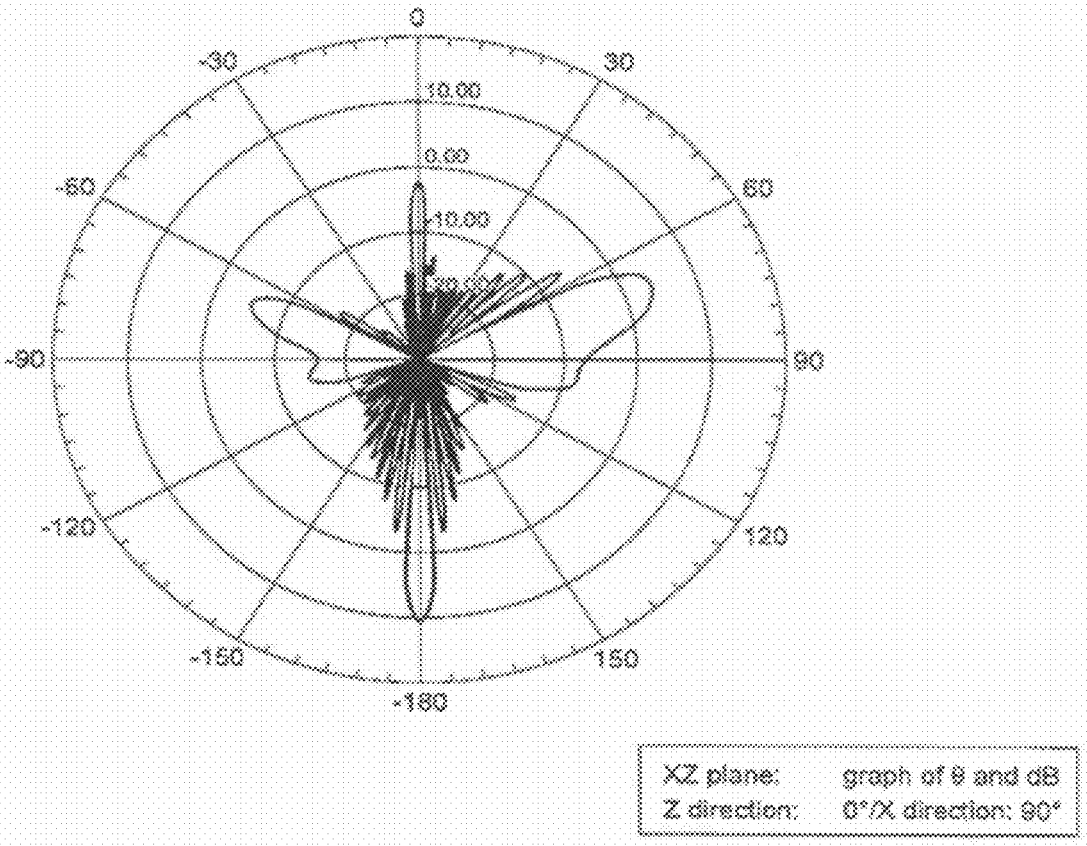
FIG. 21 is a graph showing a far scattered field in a tapered mushroom structure according to a sixth embodiment of the present invention.

FIG. 21 shows a far scattered field then. As shown in FIG. 21, although the level of the maximum radiation direction is 4.15 dB, which is smaller than 9.12 dB in the case of 450 $mm^2$, the reflected waves bend in the direction of 70°.

Seventh Embodiment of the Present Invention

Figure 22:
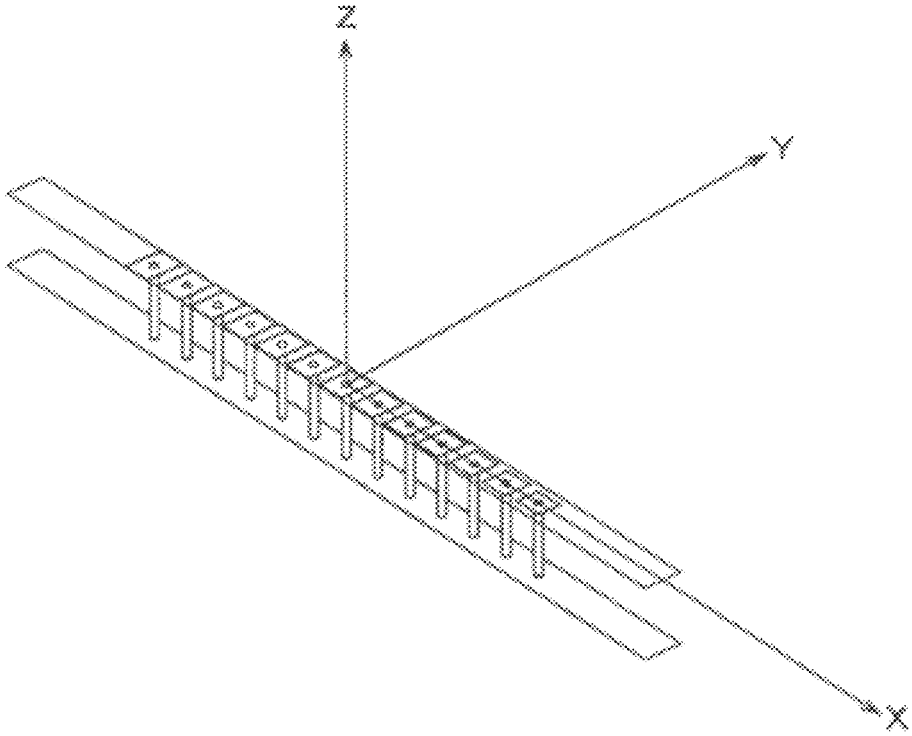
FIG. 22 is a view showing one block forming a tapered mushroom structure according to a seventh embodiment of the present invention.

A tapered mushroom structure according to a seventh embodiment of the present invention will be described hereinafter. FIG. 22 shows one block forming the tapered mushroom structure according to this embodiment, and FIG. 23 shows structural parameters to be used in the tapered mushroom structure according to this embodiment.

This embodiment shows an example of when pitch $a_x$ of the mushroom elements in the X axis direction and pitch $a_y$ of the mushroom elements in the Y axis direction are in almost the same size as 1.8 mm and the period T is 36 mm, in the tapered mushroom structure according to the present invention.

Figure 23:
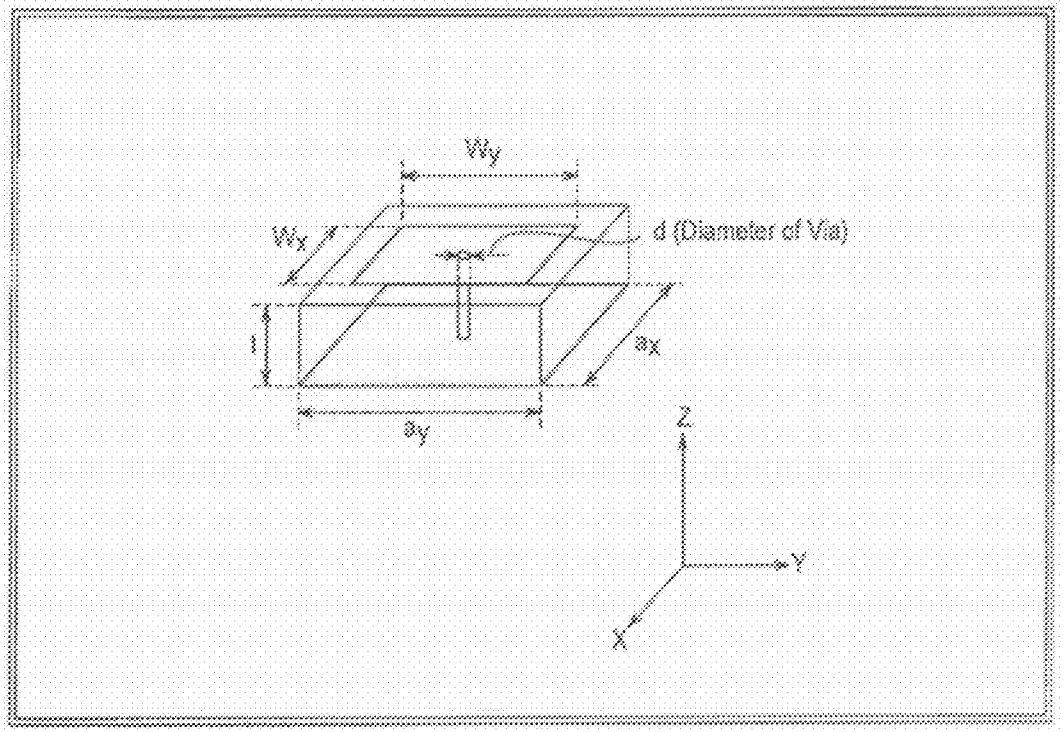
FIG. 23 is a view showing structural parameters of the tapered mushroom structure according to the seventh embodiment of the present invention.

In this embodiment, the design conditions are as shown in FIG. 24, the frequency is 8.8 GHz and vertically polarized waves is used (the coordinates are shown in FIG. 23 here), and beams bend in the direction of θ=70° when they enter.

In addition, it is supposed that the dielectric substrate 1 has the relative permittivity of 4.4 and thickness of 3.2 mm, and tan δ=0.018. FIG. 25 shows the structural parameters.

FIG. 26 shows phases of reflection coefficients for the length of $W_y$ then. FIG. 27 shows values of $W_y$ selected so that a phase difference for every pitch $a_x$ in the X axis direction will be Π/10.

Figure 28:
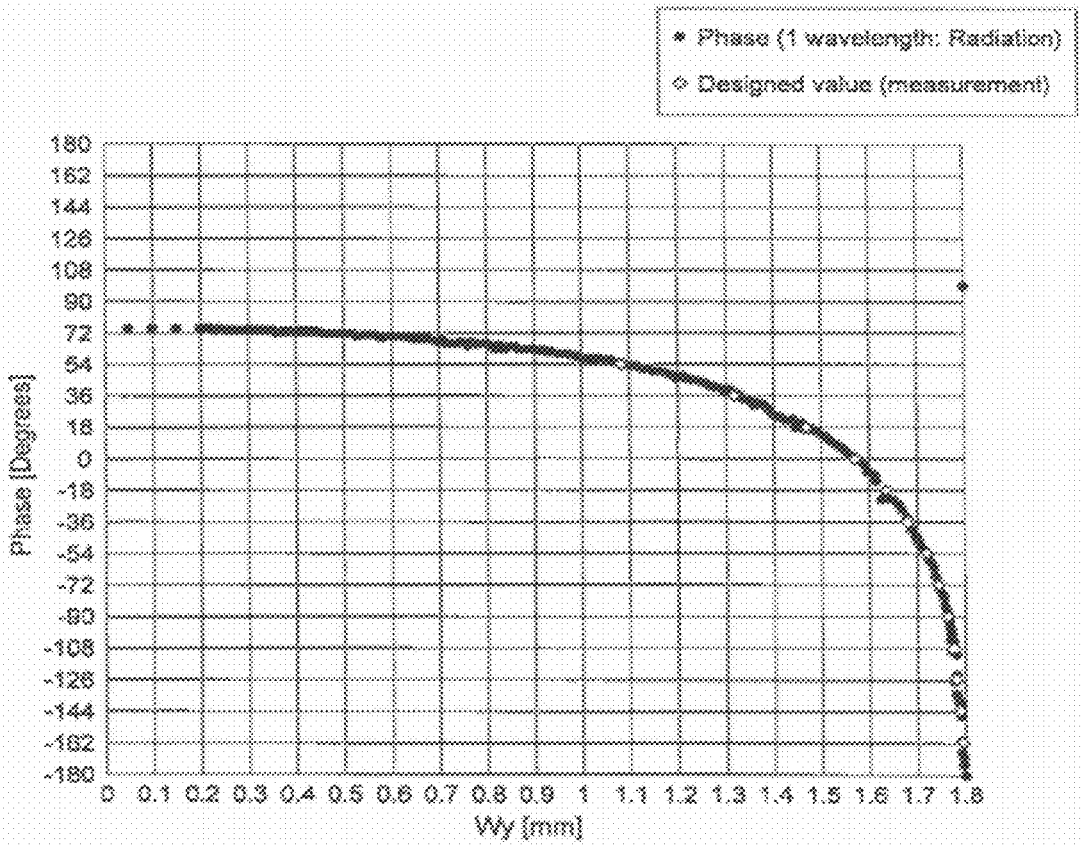
FIG. 28 is a view showing structural parameters to be used in the tapered mushroom structure according to the seventh embodiment of the present invention.
Figure 28:
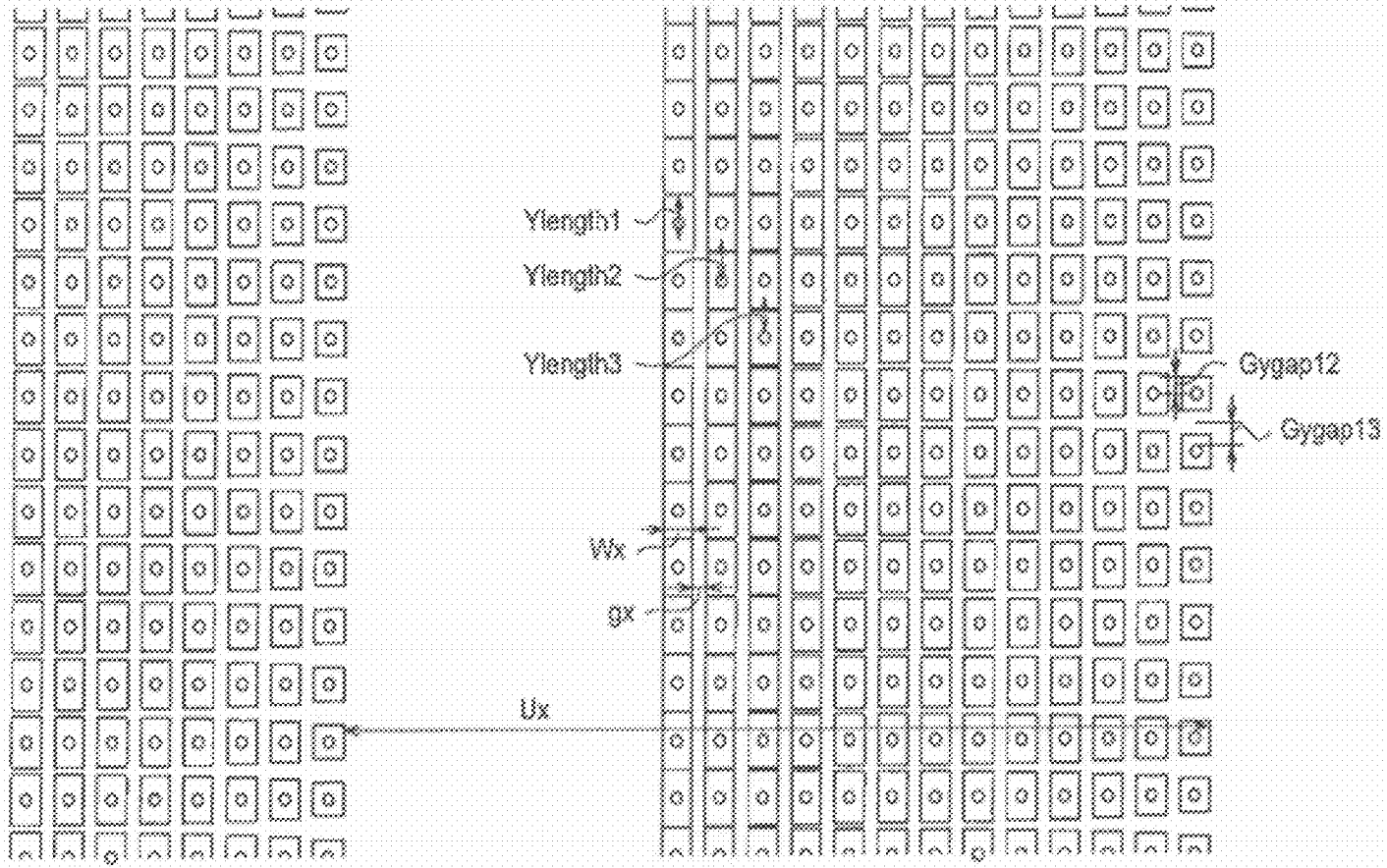

FIG. 28 and FIG. 29 show details of structural parameters to be used in the tapered mushroom structure according to this embodiment and their values.

Figure 30:
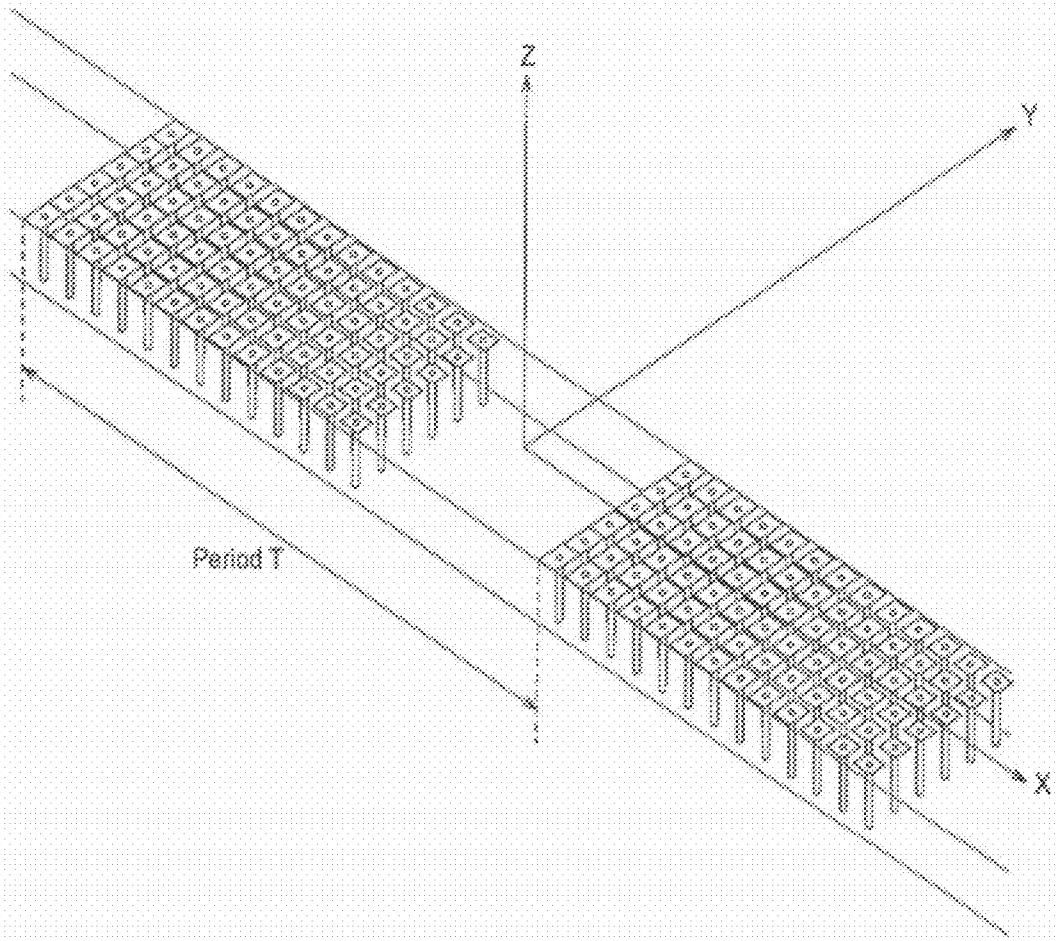
FIG. 30 is a view showing one block forming the tapered mushroom structure according to the seventh embodiment of the present invention.
Figure 31:
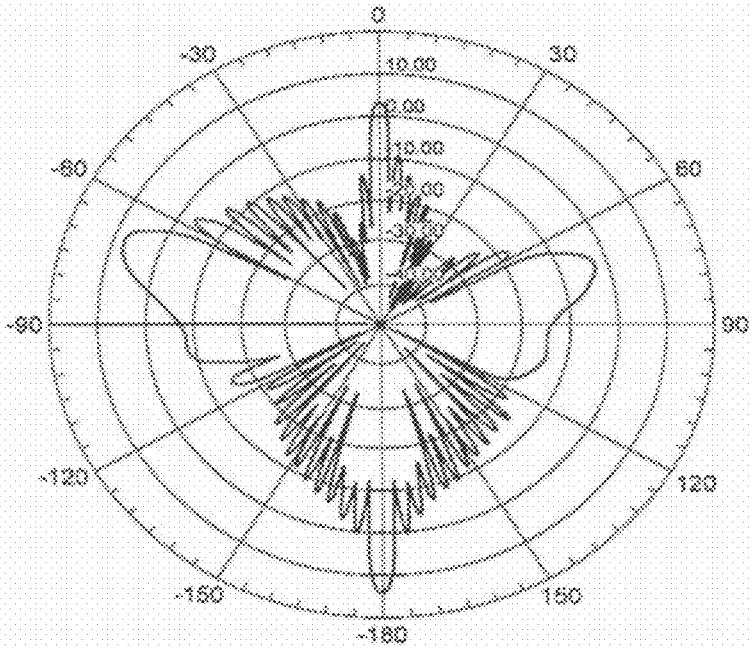
FIG. 31 is a graph showing a far scattered field in the tapered mushroom structure according to the seventh embodiment of the present invention.

FIG. 30 shows a structure in which the period T is 2Π, 2 blocks are arranged in the X axis direction, and 7 blocks are arranged in the Y axis direction, and FIG. 31 shows a far scattered field when a reflector plate of 450 $mm^2$ is created by arranging 250 blocks in the Y axis direction and 12 blocks in the Y axis direction.

Eighth Embodiment of the Present Invention

A tapered mushroom structure according to the eighth embodiment will be described.

Figure 6:
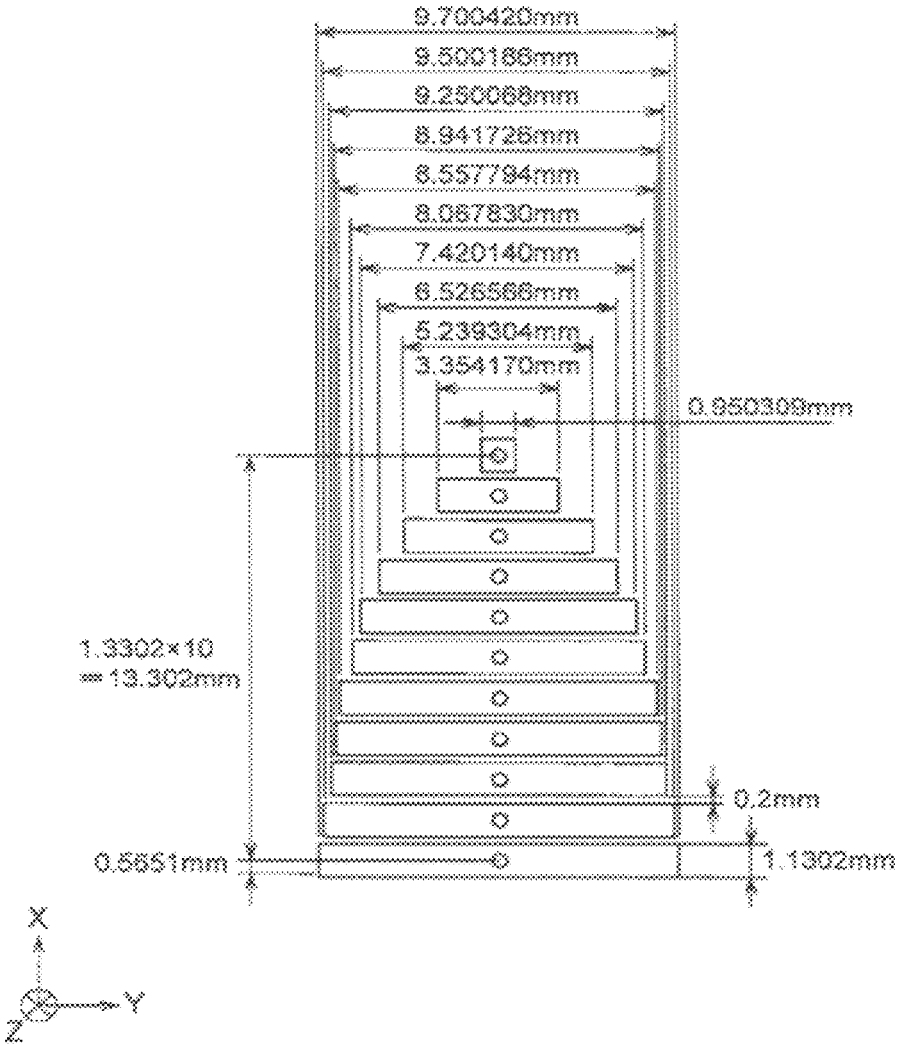
FIG. 6 is a view showing one block forming the tapered mushroom structure according to the second embodiment of the present invention.
Figure 32:
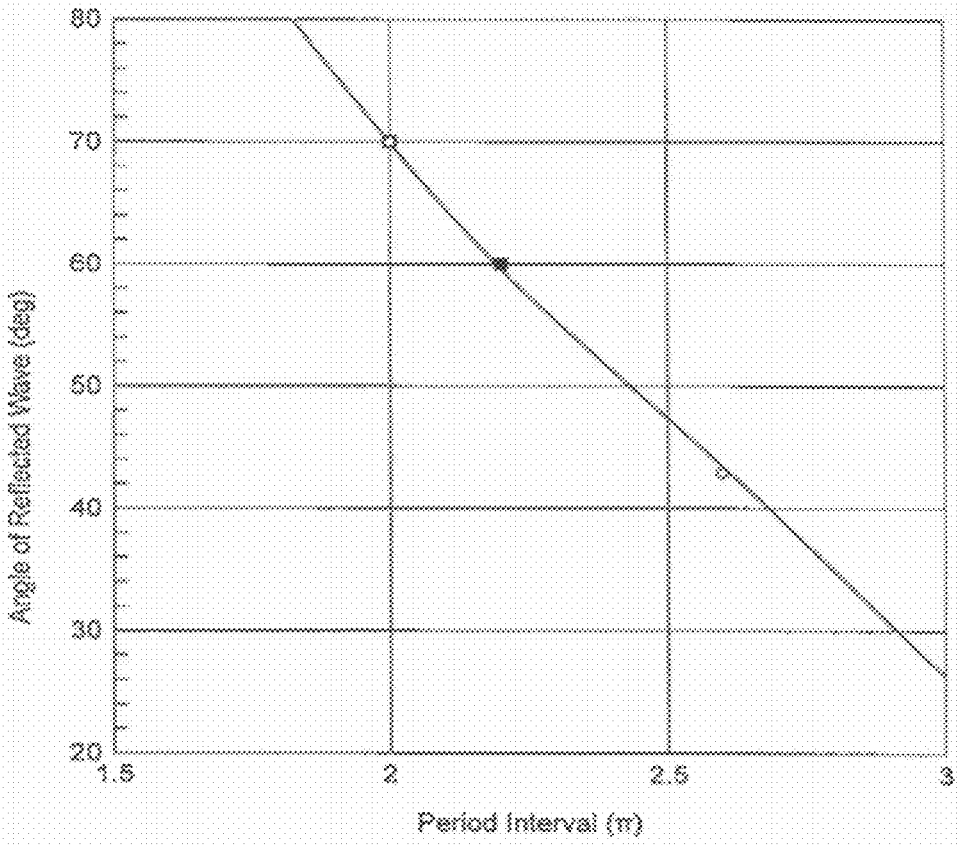
FIG. 32 is a graph showing values of radiation direction of reflected waves to a period T when the value of the period T of the block in the tapered mushroom structure is changed and the mushroom elements are arranged, in the tapered mushroom structure according to an eighth embodiment of the present invention.

FIG. 32 shows the value of the period T of the block in the tapered mushroom structure according to the fourth embodiment shown in FIG. 11, and values of the reflected waves in the radiation direction to the period T when the mushroom elements are arranged by changing the value of the period T of the block in the tapered mushroom structure according to the second embodiment shown in FIG. 6.

As shown in FIG. 32, it can be seen that the direction of the reflected waves can be changed 40° or more, by changing T from 2Π to 3Π.

Figure 33:
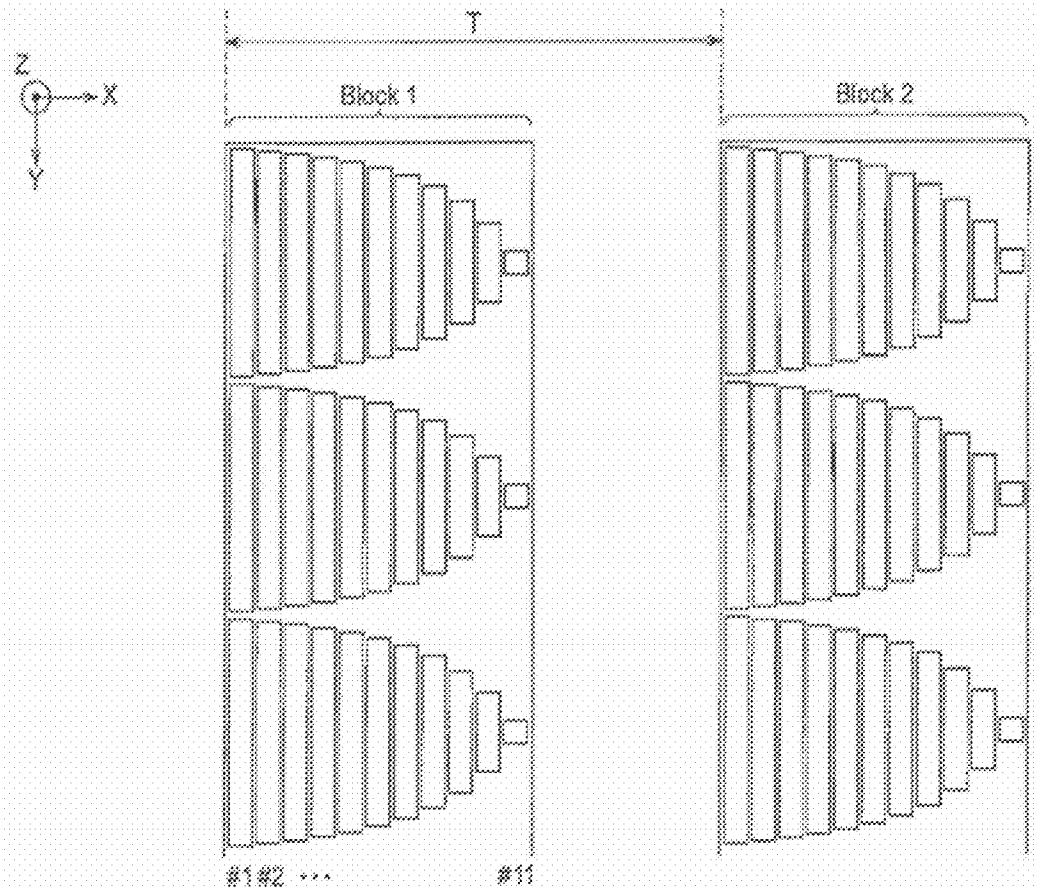
FIG. 33 is a view for describing how the tapered mushroom structure and the phases are when the period T is changed, in the tapered mushroom structure according to the eighth embodiment of the present invention.

FIG. 33 is a view for describing how the tapered mushroom structure and the phases are when the period T is changed.

In FIG. 33, the mushroom element #1 of the block 1 and the mushroom element #1 of the block 2 are in the same phase and both are spaced by the interval of the period T.

This also applies to the mushroom elements #2 to #11. In addition, there is a phase difference of Π/10 between the mushroom element #1 and the mushroom element #2. This enables the direction of reflected waves to be controlled by changing the period T.

Ninth Embodiment of the Present Invention

A tapered mushroom structure according to a ninth embodiment of the present invention will be described hereinafter.

Figure 34:
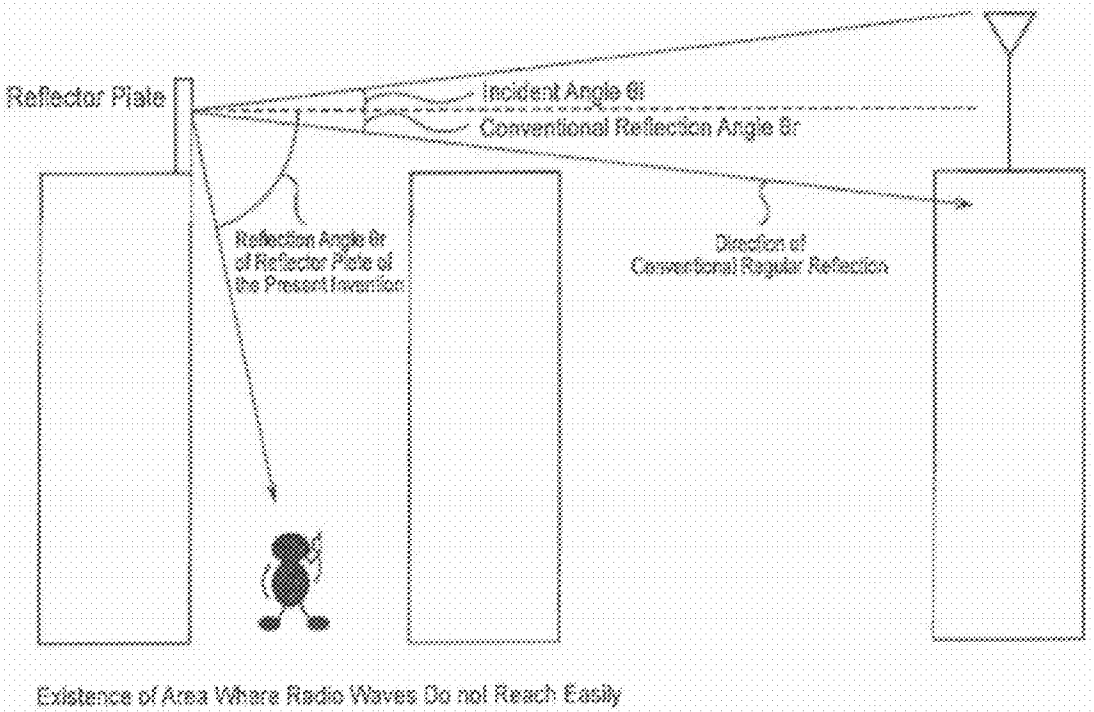
FIG. 34 is a view for describing a radio communication system according to a ninth embodiment of the present invention.

FIG. 34 shows a radio communication system according to a ninth embodiment of the present invention which enables radio waves to reach by using the periodic structure reflector plate (tapered mushroom structure) of the present invention, in the environment such that radio waves cannot easily reach a direction in which a mobile station j is located even if a reflector plate is installed in the conventional specular reflection.

Figure 35:
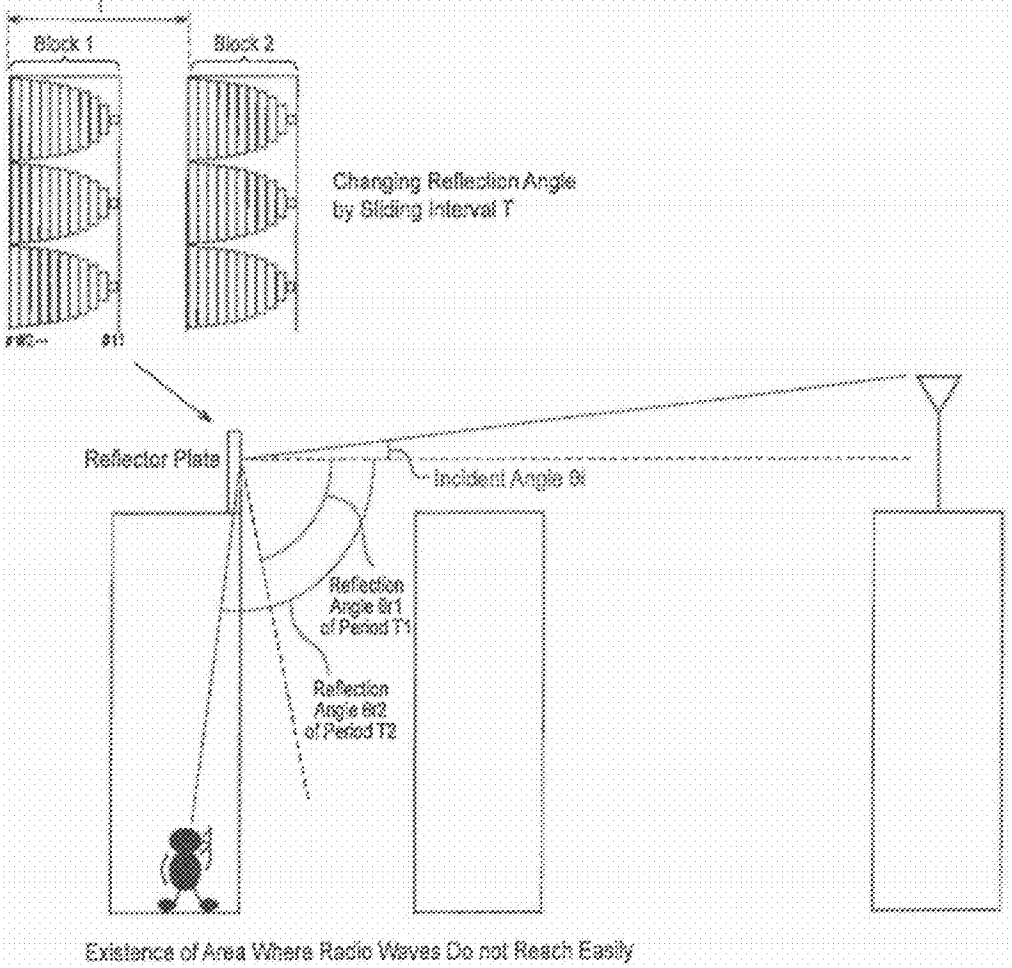
FIG. 35 is a view for describing the radio communication system according to the ninth embodiment of the present invention.

In the radio communication system according to this embodiment, a reflection angle can be changed to a desired direction by sliding a period T of a reflector plate, as shown in FIG. 35, when there arises a need to change the initially assumed reflection angle θr1 to θr2, due to environmental changes. A method of sliding may be manual or mechanically driven.

Tenth Embodiment of the Present Invention

A tapered mushroom structure according to a tenth embodiment of the present invention will be described hereinafter.

Figure 42:
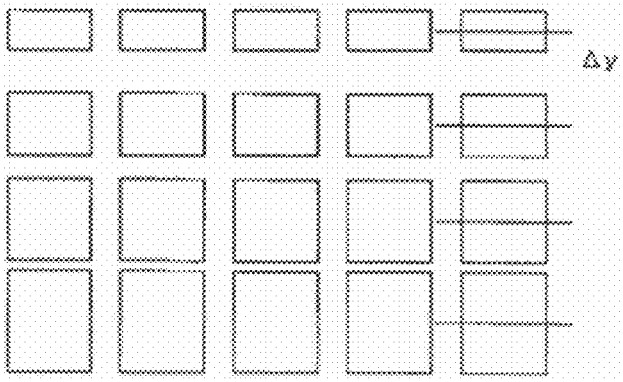
FIG. 42 is a view showing one example of a tapered mushroom structure according to a tenth embodiment of the present invention.

FIG. 42 shows an example of a configuration in which when an electric field of incoming incident wave is directed to direction Y, length $LY_{ij}$ of each mushroom element in the Y axis direction is changed by being inclined along the Y axis direction. Now, "$\alpha=\sin^{-1}(\text{“}(\lambda\cdot\Delta\Phi)/(2\Pi\cdot\Delta y))$". Then, on the YZ plane, an angle indicative of a desired traveling direction of the reflected wave can be changed by α, with respect to the specular reflection.

Eleventh Embodiment of the Present Invention

A tapered mushroom structure according to an eleventh embodiment of the present invention will be described hereinafter.

Figure 41:
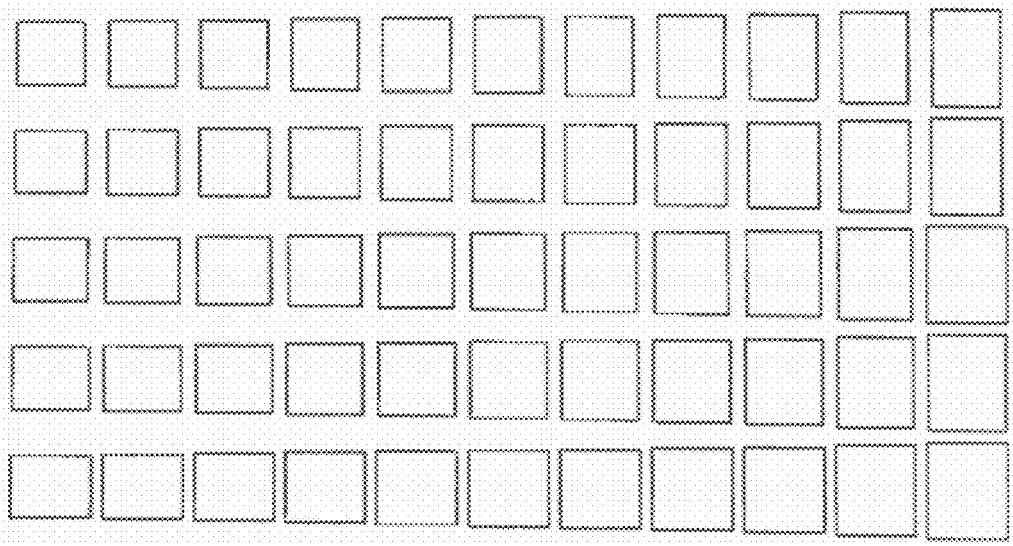
FIG. 41 is a view showing one example of a tapered mushroom structure according to an eleventh embodiment of the present invention.

In FIG. 41, a configuration may be such that when an electric field of incoming incident wave is directed to direction Y, length $LY_{ij}$ of each mushroom element in the Y axis direction is changed by not only inclining it along the X axis direction, but also inclining it along the Y axis direction.

Twelfth Embodiment of the Present Invention

A tapered mushroom structure according to a twelfth embodiment of the present invention will be described hereinafter.

If an electric field of incoming incident wave is directed to X direction, length $LX_{ij}$ of each mushroom element in the X direction may be configured to be changed by being inclined along the Y axis direction, and "$\alpha=\sin^{-1}((\lambda\cdot\Delta\Phi)/(2\Pi\cdot\Delta y))$" may be set.

Thirteenth Embodiment of the Present Invention

A tapered mushroom structure according to a thirteenth embodiment of the present invention will be described hereinafter.

In such a tapered mushroom structure, a configuration may be such that not only length $LY_{ij}$ of each mushroom element in a Y axis direction is changed by being inclined along an X axis direction, but also length $LX_{ij}$ of each mushroom element in the X axis direction is changed by being inclined along the Y axis direction.

Fourteenth Embodiment of the Present Invention

A tapered mushroom structure according to a fourteenth embodiment of the present invention will be described hereinafter.

In such a tapered mushroom structure, a configuration may be such that not only length $LY_{ij}$ of each mushroom element in Y axis direction is changed by being inclined along a Y axis direction and an X axis direction, but also length $LX_{ij}$ of each mushroom element in the X axis direction is changed by being inclined along the X axis direction and the Y axis direction.

Modification Example 1

Figure 37:
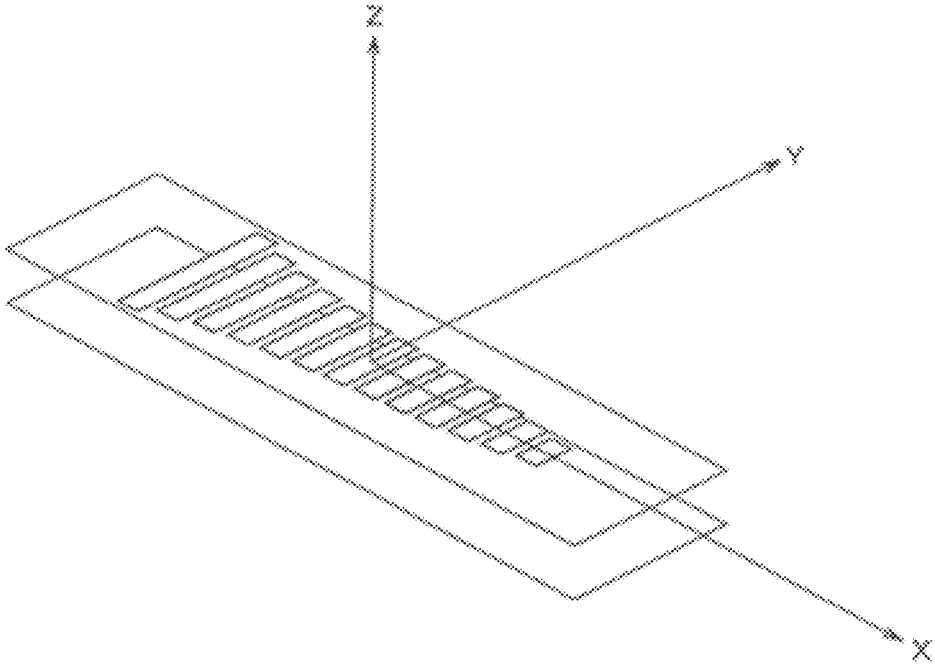
FIG. 37 is a view showing one block forming the tapered mushroom structure according to Modification Example 1 of the present invention.
Figure 3B:
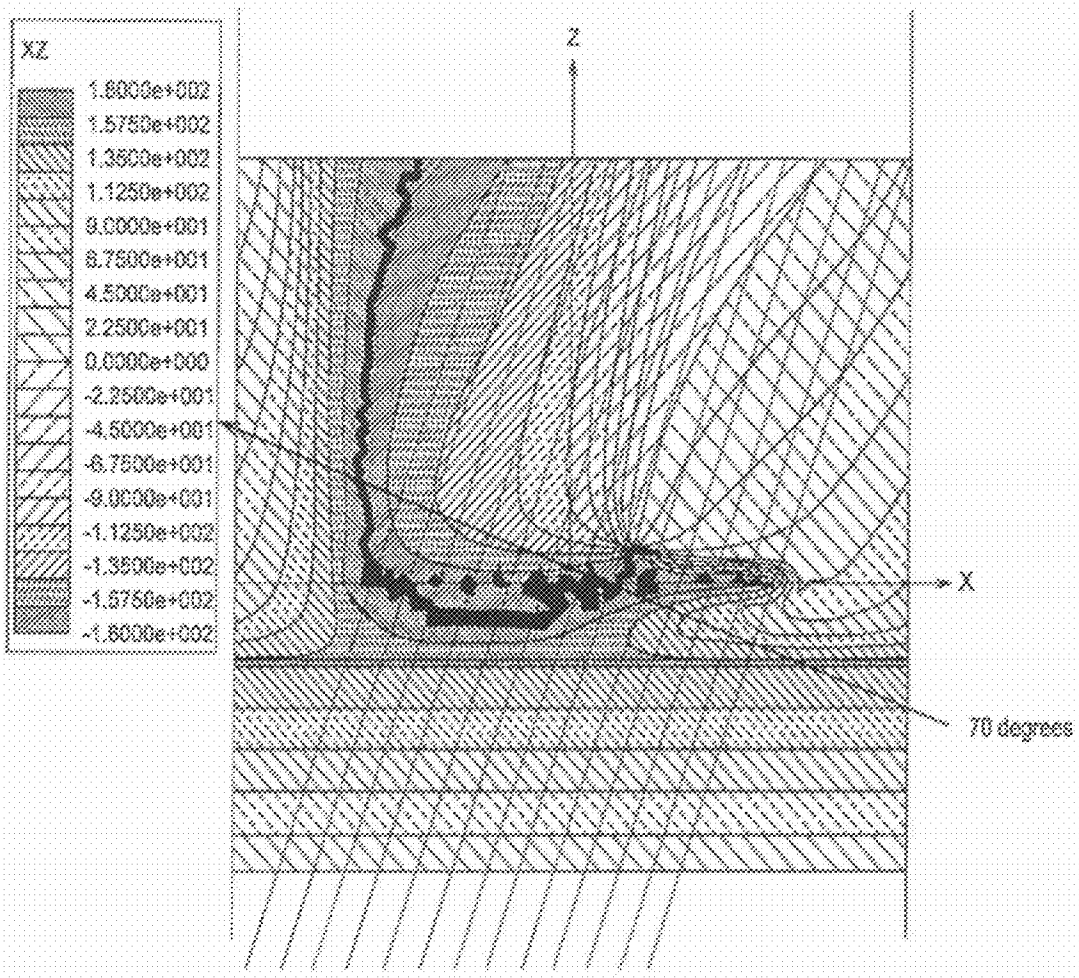
Figure 39:
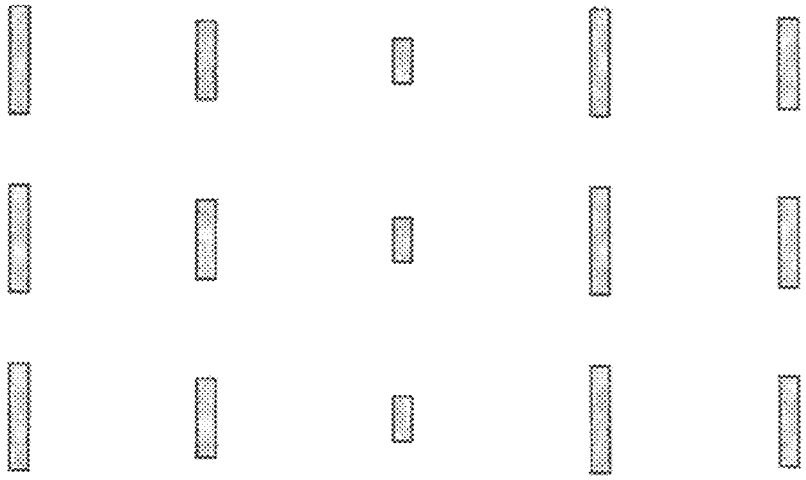

FIG. 36 and FIG. 37 show a mushroom structure in which mushroom elements 2 without a via hole 3, which are formed of a dielectric substrate 1 and patches 2A are arranged. Here, length of the patches 2A is determined by a phase difference.

FIG. 38 shows a contour figure of phrases of reflection coefficients in such a tapered mushroom structure. As shown in FIG. 38, it can be seen that phase differences are clearly shown depending on length of the patch 2A in the tapered mushroom structure.

Modification Example 2

Figure 39:
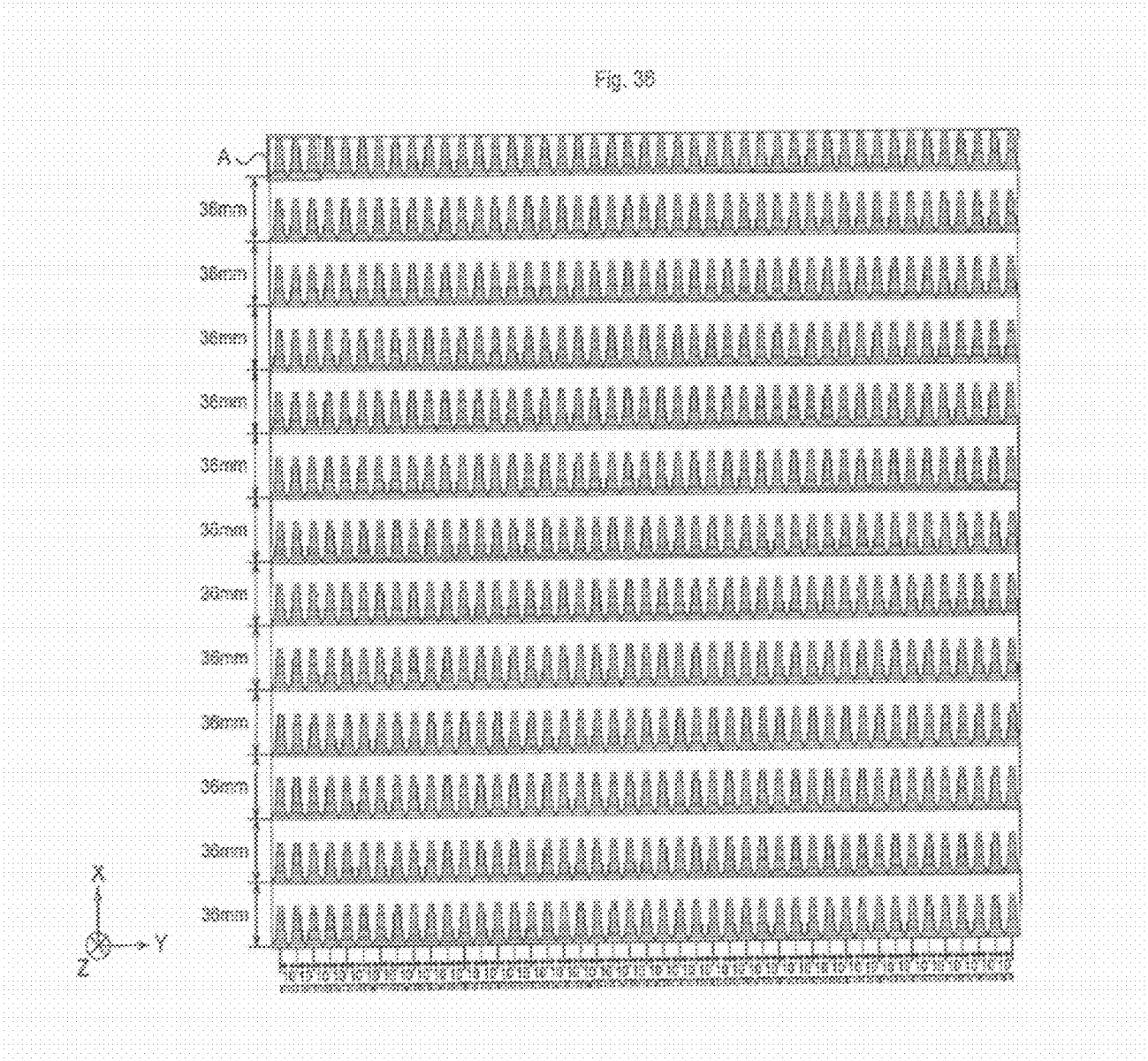
FIG. 39 is a view showing the tapered mushroom structure according to Modification Example 2 of the present invention.

In addition, FIG. 39 shows a tapered mushroom structure only formed of strip-shaped metals.

Figure 40:
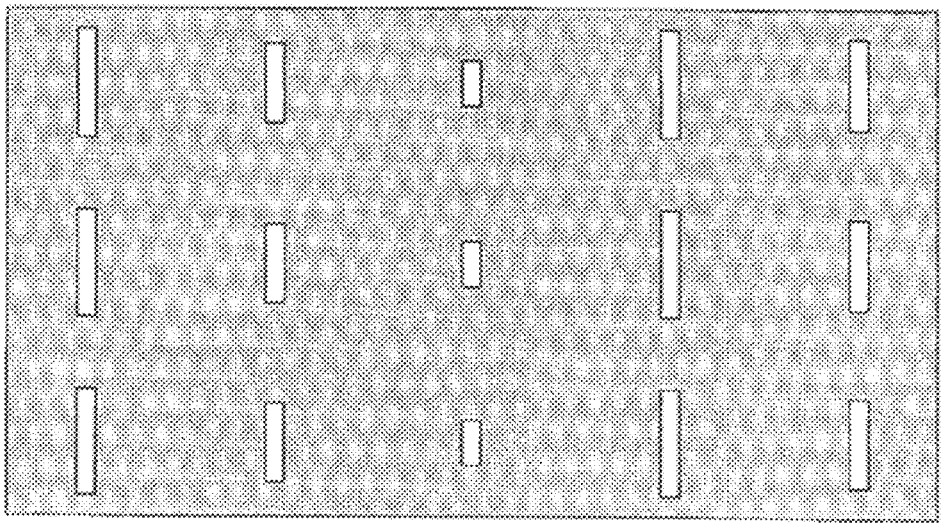
FIG. 40 is a view showing the tapered mushroom structure according to Modification Example 2 of the present invention.

Furthermore, FIG. 40 shows a tapered mushroom structure only formed of strip-shaped slots.

As described above, the present invention can provide a radio communication system, a periodic structure reflector plate, and a tapered mushroom structure, capable of: configuring the size of a reflector plate having a function to control a direction in which reflected waves travel so that the reflected waves travel in a desired direction; easily carrying out control; and operating beams in a two-dimensional manner.

So far the present invention has been described in detail using the embodiments described above. However, it is apparent to those skilled in the art that the present invention should not be limited to the embodiments described herein. The present invention can be carried out as a corrected or modified aspect without departing from the sprit and the scope of the present invention which are defined by the description in the claims. Therefore, the description of the application is designed for exemplification and has no restrictive meaning to the present invention.

What is claimed is:

1. A periodic structure reflector plate, comprising:

a structure in which structures each for controlling a reflection angle by controlling a phase difference of reflected waves are periodically arranged, wherein in n reflector plate constituent pieces $r_k$ ($1\leqq k\leqq n$) arranged at intervals of $\Delta S_k$, when a phase of reflected wave in each reflector plate constituent piece $r_k$ is $\Phi_k$, a phase difference ($\Phi_{k+1}-\Phi_k$) between each reflector plate constituent piece $r_k$ and an adjacent reflector plate constituent piece $r_{k+1}$ is $\Delta\Phi_k$, and wavelength of the reflected wave is $\lambda$, a plurality of blocks are provided for every period T ($T\geqq RL$), each of the blocks being formed of the n reflector plate constituent pieces $r_k$ that are arranged to satisfy an expression #1 "$\alpha=\sin^{-1}(\lambda\cdot\Delta\Phi_k/2\Pi\cdot\Delta S_k)$" for an angle $\alpha$ indicative of a traveling direction of desired reflected wave, each of the blocks having a length RL specified by:

$$RL=\sum_{K=1}^{n}\Delta S_k.$$

2. The periodic structure reflector plate according to claim 1, wherein the period T is a value for which "$T=\lambda/\sin\alpha$" is true.

3. A tapered mushroom structure formed of mushroom elements including a dielectric substrate having a metal ground plate as a bottom face, strip-shaped patches formed on an upper surface of the dielectric substrate, and short pins short-circuiting the metal ground plate and the patches, wherein n mushroom elements are arranged at predetermined intervals of $\Delta X_i$ in an X axis direction, and m mushroom elements are arranged at predetermined intervals of $\Delta Y_j$ in a Y axis direction;

the length $LY_{ij}$ of each mushroom element in the Y axis direction is changed by being inclined along the X axis direction, the length $LX_i$ of each mushroom element in the X axis direction is changed by being inclined along the Y axis direction, or not only the length $LY_{ij}$ of each mushroom element in the Y axis direction is changed by being inclined along the X axis direction, but also the length $LX_{ij}$ of each mushroom element in the X axis direction is changed by being inclined along the Y axis direction; and the length of each mushroom element is determined so that a phase of a reflection coefficient when radio wave is reflected in each mushroom element is parallel to a straight line set arbitrarily on an XY plane.

4. The tapered mushroom structure according to claim 3, wherein the length $LY_{ij}$ of each mushroom element in the Y axis direction is changed by being inclined along the Y axis direction and the X axis direction.

5. The tapered mushroom structure according to claim 3, wherein the length $LX_{ij}$ of each mushroom element in the X axis direction is changed by being inclined along the Y axis direction and the X axis direction.

6. The tapered mushroom structure according to claim 3, wherein if the m or n mushroom elements cannot be arranged due to restrictions on the length $LX_{ij}$ in the X axis direction and the length $LY_{ij}$ in the Y axis direction which are determined by the predetermined intervals $\Delta X_i$ and $\Delta Y_j$, blocks in which the mushroom elements are arranged at the predetermined intervals $\Delta X_i$ in the X axis direction and at the predetermined intervals $\Delta Y_j$ in the Y axis direction are periodically and repeatedly arranged.

7. The tapered mushroom structure according to claim 3, wherein each mushroom element is arranged so that there is no lag in a phase difference between the $k^{th}$ mushroom element and the $k-1^{th}$ mushroom element with respect to any k.

8. The tapered mushroom structure according to claim 3, wherein each mushroom element is arranged so that there is no phase difference between the $p^{th}$ period and the $p-1^{th}$ period with respect to any P.

9. The tapered mushroom structure according to claim 3, wherein in the mushroom elements to be arranged at intervals of $\Delta x$, when a phase difference of a reflection coefficient at each mushroom element is $\Delta\Phi$ and wavelength of a reflected wave is $\lambda$, an angle $\alpha$ indicative of a desired traveling direction of a reflected wave is determined by an expression #2"$\alpha=\sin^{-1}(\lambda\cdot\Delta\Phi/2\Pi\cdot\Delta X)$";

the reflection coefficient $\Gamma$ is determined by an expression #3 "$\Gamma=(Z_s-\eta)/(Z_s+\eta)=|\Gamma|\exp(j)$", using a free space impedance $\eta$ and a surface impedance $Z_s$; and when the surface impedance $Z_s$ is determined by an expression #4 "$Z_s=j\omega L/(1-\omega^2LC)$", using inductance L and capacitance C which are determined by the tapered mushroom structure, the i mushroom elements are arranged in the X axis direction, the phases of the reflection coefficient, which are approximately determined from the inductance L and the capacitance $\Delta$, are at regular intervals for the every interval $\Delta x$ so that the phase difference $\Delta\Phi$ will be equal, and blocks in which the i mushroom elements are arranged in the X axis direction are arranged at intervals of a predetermined period T.

10. A tapered mushroom structure formed of mushroom elements including a dielectric substrate having a metal ground plate as a bottom face, strip-shaped patches formed on an upper surface of the dielectric substrate, and short pins short-circuiting the metal ground plate and the patches, wherein n mushroom elements are arranged at predetermined intervals of $\Delta X_i$ in an X axis direction, and m mushroom elements are arranged at predetermined intervals of $\Delta Y_j$ in a Y axis direction;

the length $LY_{ij}$ of each mushroom element in the Y axis direction is changed by being inclined along the Y axis direction, the length $LX_{ij}$ of each mushroom element in the X axis direction is changed by being inclined along the X axis direction, or not only the length $LY_{ij}$ of each mushroom element in the Y axis direction is changed by being inclined along the Y axis direction but also the length $LX_{ij}$ of each mushroom element in the X axis direction is changed by being inclined along the X axis direction; and the length of each mushroom element is determined so that a phase of a reflection coefficient when radio waves are reflected at each mushroom element is parallel to a straight line arbitrarily set on an XY plane.

11. The tapered mushroom structure according to claim 10, wherein the length $LY_{ij}$ of each mushroom element in the Y axis direction is changed by being inclined along the Y axis direction and the X axis direction.

12. The tapered mushroom structure according to claim 10, wherein the length of each mushroom element in the X axis direction is changed by being inclined along the Y axis direction and the X axis direction.

13. The tapered mushroom structure according to claim 10, wherein if the m or n mushroom elements cannot be arranged due to restrictions on the length $LX_{ij}$ in the X axis direction and the length $LY_{ij}$ in the Y axis direction which are determined by the predetermined intervals $\Delta X_i$ and $\Delta Y_j$, blocks in which the mushroom elements are arranged at the predetermined intervals $\Delta X_i$ in the X axis direction and at the predetermined intervals $\Delta Y_j$ in the Y axis direction are periodically and repeatedly arranged.

14. The tapered mushroom structure according to claim 10, wherein each mushroom element is arranged so that there is no lag in a phase difference between the $k^{th}$ mushroom element and the $k-1^{th}$ mushroom element with respect to any k.

15. The tapered mushroom structure according to claim 10, wherein each mushroom element is arranged so that there is no phase difference between the $p^{th}$ period and the $p-1^{th}$ period with respect to any P.

16. The tapered mushroom structure according to claim 7, wherein in the mushroom elements to be arranged at intervals of $\Delta x$, when a phase difference of a reflection coefficient at each mushroom element is $\Delta\Phi$ and wavelength of a reflected wave is $\lambda$, an angle $\alpha$ indicative of a desired traveling direction of a reflected wave is determined by an expression #2 "$\alpha=\sin^{-1}(\lambda\cdot\Delta\Phi/2\Pi\cdot\Delta X)$";

the reflection coefficient $\Gamma$ is determined by an expression #3 "$\Gamma=(Z_s-\eta)/(Z_s+\eta)=|\Gamma|\exp(j)$", using a free space impedance $\eta$ and a surface impedance $Z_s$; and when the surface impedance $Z_s$ is determined by an expression #4 "$Z_s=j\omega L/(1-\omega^2LC)$", using inductance L and capacitance C which are determined by the tapered mushroom structure, the i mushroom elements are arranged in the X axis direction, the phases of the reflection coefficient, which are approximately determined from the inductance L and the capacitance C, are at regular intervals for the every interval $\Delta x$ so that the phase difference $\Delta\phi$ will be equal, and blocks in which the i mushroom elements are arranged in the X axis direction are arranged at intervals of a predetermined period T.

17. A periodic structure reflector plate, comprising:

a structure in which structures each for controlling a reflection angle by controlling a phase difference of reflected waves are periodically arranged; and a tapered mushroom structure formed of mushroom elements including a dielectric substrate having a metal ground plate as a bottom face, strip-shaped patches formed on an upper surface of the dielectric substrate, and short pins short-circuiting the metal ground plate and the patches, wherein n mushroom elements are arranged at predetermined intervals of $\Delta X_i$ in an X axis direction, and m mushroom elements are arranged at predetermined intervals of $\Delta Y_j$ in a Y axis direction, the length $LY_{ij}$ of each mushroom element in the Y axis direction is changed by being inclined along the X axis direction, the length $LX_{ij}$ of each mushroom element in the X axis direction is changed by being inclined along the Y axis direction, or not only the length $LY_{ij}$ of each mushroom element in the Y axis direction is changed by being inclined along the X axis direction, but also the length $LX_{ij}$ of each mushroom element in the X axis direction is changed by being inclined along the Y axis direction, and the length of each mushroom element is determined so that a phase of a reflection coefficient when radio wave is reflected in each mushroom element is parallel to a straight line set arbitrarily on an XY plane.

18. A periodic structure reflector plate, comprising:

a structure in which structures each for controlling a reflection angle by controlling a phase difference of reflected waves are periodically arranged; and a tapered mushroom structureformed of mushroom elements including a dielectric substrate having a metal ground plate as a bottom face, strip-shaped patches formed on an upper surface of the dielectric substrate, and short pins short-circuiting the metal ground plate and the patches, wherein n mushroom elements are arranged at predetermined intervals of $\Delta X_i$ in an X axis direction, and m mushroom elements are arranged at predetermined intervals of $\Delta Y_j$ in a Y axis direction, the length $LY_{ij}$ of each mushroom element in the Y axis direction is changed by being inclined along the Y axis direction, the length $LX_{ij}$ of each mushroom element in the X axis direction is changed by being inclined along the X axis direction, or not only the length $LY_{ij}$ of each mushroom element in the Y axis direction is changed by being inclined along the Y axis direction but also the length $LX_{ij}$ of each mushroom element in the X axis direction is changed by being inclined along the X axis direction, and the length of each mushroom element is determined so that a phase of a reflection coefficient when radio waves are reflected at each mushroom element is parallel to a straight line arbitrarily set on an XY plane.

* * * * *